US009668570B2

(12) United States Patent
Mojtabavi et al.

(10) Patent No.: US 9,668,570 B2
(45) Date of Patent: Jun. 6, 2017

(54) COMPACT FOLDING FURNITURE PIECES

(71) Applicant: Aria Enterprises, Inc., Portland, OR (US)

(72) Inventors: Mehdi Mojtabavi, Vancouver, WA (US); Sohrab Vossoughi, Portland, OR (US); David Randall Knaub, Portland, OR (US); Ken Dieringer, Portland, OR (US)

(73) Assignee: Aria Enterprises, Inc., Portland, OR (US)

( * ) Notice: Subject to any disclaimer, the term of this patent is extended or adjusted under 35 U.S.C. 154(b) by 105 days.

(21) Appl. No.: 14/803,981

(22) Filed: Jul. 20, 2015

(65) Prior Publication Data

US 2015/0320197 A1 Nov. 12, 2015

Related U.S. Application Data

(66) Division of application No. 13/696,017, filed as application No. PCT/US2011/036905 on May 18,
(Continued)

(51) Int. Cl.

| | |
|---|---|
| ***A47B 5/04*** | (2006.01) |
| ***E05D 3/06*** | (2006.01) |
| ***E05D 7/00*** | (2006.01) |
| ***E05D 11/06*** | (2006.01) |
| ***E05D 11/10*** | (2006.01) |

(Continued)

(52) U.S. Cl.

CPC ..... *A47B 5/04* (2013.01); *A47B 3/08* (2013.01); *A47B 96/202* (2013.01); *A47C 1/121* (2013.01); *A47C 4/08* (2013.01); *A47C 7/445* (2013.01); *A47C 9/06* (2013.01); *E05D 3/06* (2013.01);
(Continued)

(58) Field of Classification Search

USPC ..... 297/354.11, 452.15; 108/47, 48, 152
See application file for complete search history.

(56) References Cited

U.S. PATENT DOCUMENTS 3,083,052 A * 3/1963 Thorson ..... A47B 13/023 108/150
3,215,468 A 11/1965 Swenson et al.
(Continued)

FOREIGN PATENT DOCUMENTS

CN 101263992 A 9/2008
CN 201238768 Y 5/2009
(Continued)

*Primary Examiner* — David E Allred
(74) *Attorney, Agent, or Firm* — Stoel Rives LLP

(57) ABSTRACT

A compact folding furniture piece constructed as a table is configured for convenient storage. The folding furniture piece comprises an object support assembly that is configured for operative connection to a mounting structure and includes a spring mechanism securing together as a flexible unit a support mount, an articulated vertebral column, and a table base. The spring mechanism exhibits flexibility properties such that the object support assembly assumes at rest an unfolded state and, in response to an externally applied bending force, assumes a folded state. In the unfolded state, the vertebral column is substantially straight to provide a closed support surface. In the folded state, the vertebral column is curved to provide a raised, open support surface on which an object can rest.

14 Claims, 36 Drawing Sheets

Related U.S. Application Data

2011, now Pat. No. 9,084,476, Substitute for application No. 61/345,854, filed on May 18, 2010.

(51) Int. Cl.

| | |
|---|---|
| ***A47B 3/08*** | (2006.01) |
| ***A47B 96/20*** | (2006.01) |
| ***A47C 4/08*** | (2006.01) |
| ***A47C 9/06*** | (2006.01) |
| ***A47C 1/121*** | (2006.01) |
| ***A47C 7/44*** | (2006.01) |

(52) U.S. Cl.

CPC ..... *E05D 7/009* (2013.01); *E05D 11/06* (2013.01); *E05D 11/1021* (2013.01)

(56) References Cited

U.S. PATENT DOCUMENTS

| | | | | | |
|---|---|---|---|---|---|
| 3,233,885 | A | | 2/1966 | Propst | |
| 3,666,339 | A | * | 5/1972 | Neufeld | A47B 17/033 108/152 |
| 4,157,203 | A | | 6/1979 | Ambasz | |
| 4,585,272 | A | * | 4/1986 | Ballarini | A47C 3/12 297/284.3 |
| 4,644,596 | A | | 2/1987 | Hüsler | |
| 4,776,633 | A | | 10/1988 | Knoblock et al. | |
| 4,834,453 | A | | 5/1989 | Makiol | |
| 4,856,846 | A | | 8/1989 | Lohmeyer | |
| 4,981,326 | A | | 1/1991 | Heidmann | |
| 5,232,762 | A | * | 8/1993 | Ruby | A47B 96/202 138/118 |
| 5,320,410 | A | * | 6/1994 | Faiks et al. | A47C 7/445 297/285 |
| 5,518,294 | A | | 5/1996 | Ligon et al. | |
| 5,598,997 | A | | 2/1997 | Marquardt | |
| 5,649,739 | A | | 7/1997 | Zapf | |
| 5,775,034 | A | * | 7/1998 | Logue | A47B 5/06 108/37 |
| 5,887,946 | A | | 3/1999 | Raftery | |
| 6,125,771 | A | * | 10/2000 | Platt et al. | A47B 9/08 108/115 |
| 6,213,549 | B1 | | 4/2001 | Wieclawski | |
| 6,478,379 | B1 | | 11/2002 | Ambasz | |
| 6,488,335 | B1 | | 12/2002 | Cioncada | |
| 6,669,301 | B1 | | 12/2003 | Funk et al. | |
| 6,742,839 | B2 | | 6/2004 | Piretti | |
| 7,104,607 | B2 | | 9/2006 | Yasuda et al. | |
| 7,320,503 | B2 | | 1/2008 | Eysing | |
| 8,590,978 | B2 | | 11/2013 | Jaranson et al. | |
| 9,480,340 | B1 | * | 11/2016 | Harlow | A47C 7/543 |
| 2004/0128948 | A1 | * | 7/2004 | Killen | A47B 96/202 52/782.1 |
| 2007/0073387 | A1 | | 3/2007 | Forster et al. | |
| 2007/0287618 | A1 | * | 12/2007 | Verheem | A47C 7/405 482/140 |
| 2008/0217977 | A1 | | 9/2008 | Aldrich et al. | |
| 2008/0290712 | A1 | | 11/2008 | Parker et al. | |
| 2009/0261644 | A1 | * | 10/2009 | Piretti | A47C 7/282 297/344.12 |
| 2010/0109403 | A1 | * | 5/2010 | Piretti | A47C 7/445 297/301.1 |
| 2011/0177279 | A1 | * | 7/2011 | Casteras | B64G 1/222 428/53 |
| 2014/0159450 | A1 | * | 6/2014 | Guering | A47C 7/405 297/284.3 |
| 2014/0196254 | A1 | * | 7/2014 | Song | E05D 3/14 16/302 |
| 2015/0015042 | A1 | * | 1/2015 | Willingham | A47C 7/022 297/284.7 |

FOREIGN PATENT DOCUMENTS

| | | | |
|---|---|---|---|
| EP | 0151218 | A1 | 8/1985 |
| GB | 526376 | A | 9/1940 |
| WO | WO 2004/111378 | A3 | 5/2005 |
| WO | WO 2008/128561 | A2 | 10/2008 |
| WO | WO-2009/104004 | A1 | 8/2009 |

* cited by examiner

COMPACT FOLDING FURNITURE PIECES

RELATED APPLICATIONS

This application is a division of U.S. patent application Ser. No. 13/696,017, filed Jan. 4, 2013, now U.S. Pat. No. 9,084,476, which is a 371 of International Application No. PCT/US2011/036905, filed May 18, 2011, which claims benefit of U.S. Provisional Patent Application No. 61/345,854, filed May 18, 2010.

COPYRIGHT NOTICE

© 2015 Aria Enterprises, Inc. A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

TECHNICAL FIELD

This disclosure relates to furniture pieces and, in particular, to folding seats and tables each constructed with an articulated vertebral column that facilitates compact, convenient seat or table surface storage.

SUMMARY OF THE DISCLOSURE

A portable, compact folding furniture piece constructed as a seat or table is configured for convenient storage. The folding furniture piece comprises an object support assembly configured for operative connection to a mounting structure. The object support assembly includes an articulated vertebral column positioned between a support mount and a support base and a spring mechanism securing together as a flexible unit the support mount, vertebral column, and support base. The vertebral column includes multiple vertebral members. The spring mechanism exhibits flexibility properties such that the object support assembly assumes at rest an unfolded state and, in response to an externally applied bending force, assumes a folded state. In the unfolded state, the vertebral column is substantially straight to provide a closed support surface. In the folded state, the vertebral column is curved to provide a raised, open support surface on which an object can rest. Depending on the embodiment of the furniture piece, the object can be a person or thing.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
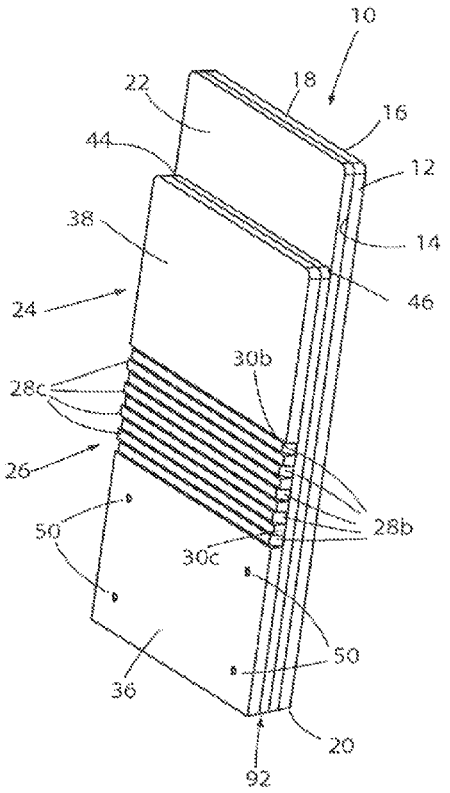
FIGS. 1 and 2 are isometric views of a portable, compact folding seat, shown in, respectively, an unfolded state and a folded state, according to one embodiment.
Figure 2:
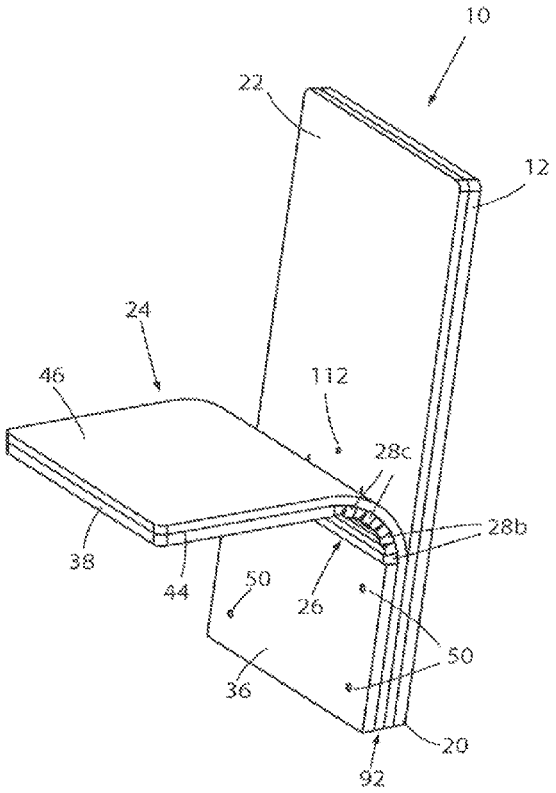
Figure 3:
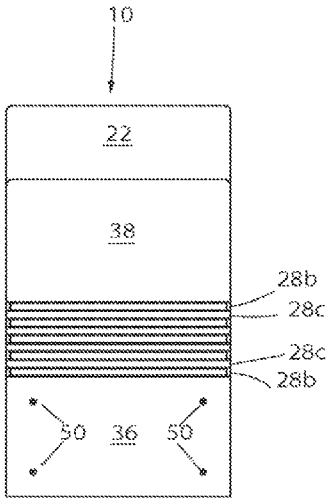
FIGS. 3, 4, and 5 are, respectively, top plan, side elevation, and bottom plan views of the folding seat in the unfolded state shown in FIG. 1.
Figure 4:
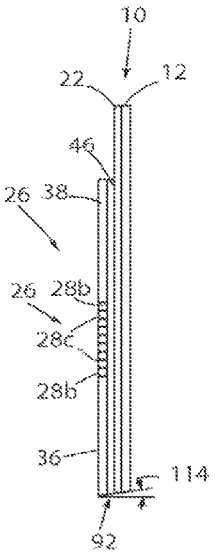
Figure 5:
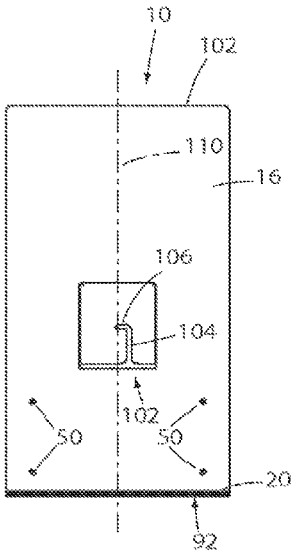

FIGS. 1 and 2 are isometric views of a portable, compact folding seat 10, in a preferred embodiment shown in, respectively, an unfolded state and a folded state. FIGS. 3, 4, and 5 are, respectively, top plan, side elevation, and bottom plan views of folding seat 10 in the unfolded state shown in FIG. 1.

With reference to FIGS. 1-5, folding seat 10 comprises a generally rectangular seat back 12 that has a seat back rest surface 14, a seat back mount surface 16, a top end 18, and a bottom end 20. A first or seat back foam layer 22 is bonded with adhesive or Velcro™ fabric hook and loop fastener material to, and covers the surface area of, seat back rest surface 14 to provide a padded seat back 12. A seat assembly 24 is positioned on seat back foam layer 22 and secured to seat back 12 near its bottom end 20. Seat assembly 24 is of shorter length than that of seat back 12. Seat assembly 24 includes a vertebral column 26 of nine lengthwise parallel-aligned beveled vertebral members or slats 28*b* and corner vertebral members or slats 28*c* of equal lengths positioned between a seat mount 36 and a seat base 38. Beveled vertebral slats 28*b* have beveled ends 30*b*, and corner vertebral slats 28*c* have right-angle corner ends 30*c*. Vertebral column 26 is formed with a beveled vertebral slat 28*b* at each end. Between the ends of vertebral column 26 is an alternating sequence of beveled vertebral slats 28*b* and corner vertebral slats 28*c* such that each corner vertebral slat 28*c* is positioned between two beveled vertebral slats 28*b*.

Figure 6:
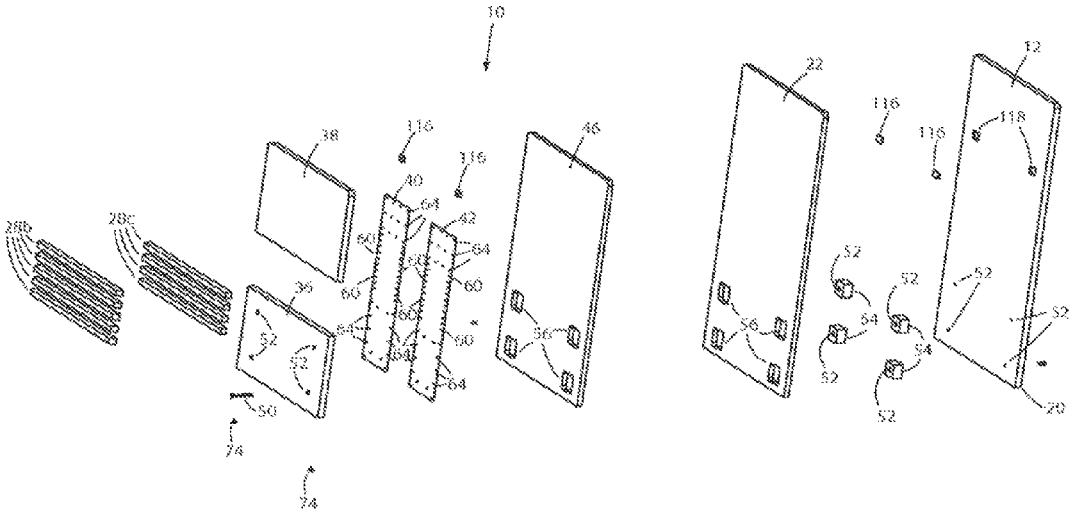
FIG. 6 is an exploded view of the folding seat shown in FIG. 1.
Figure 7B:
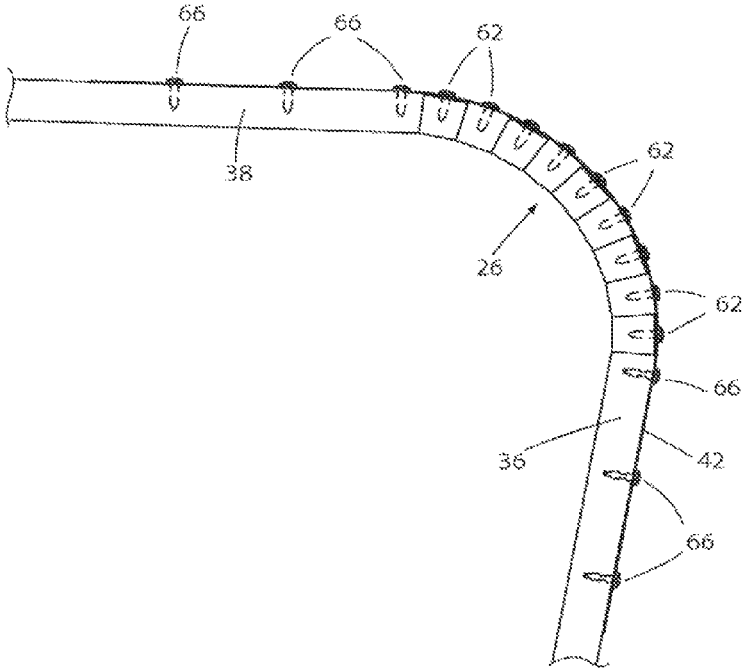
FIGS. 7A and 7B show the construction and operation of a seat assembly in, respectively, the unfolded state of FIG. 1 and the folded state of FIG. 2.
Figure 7A:
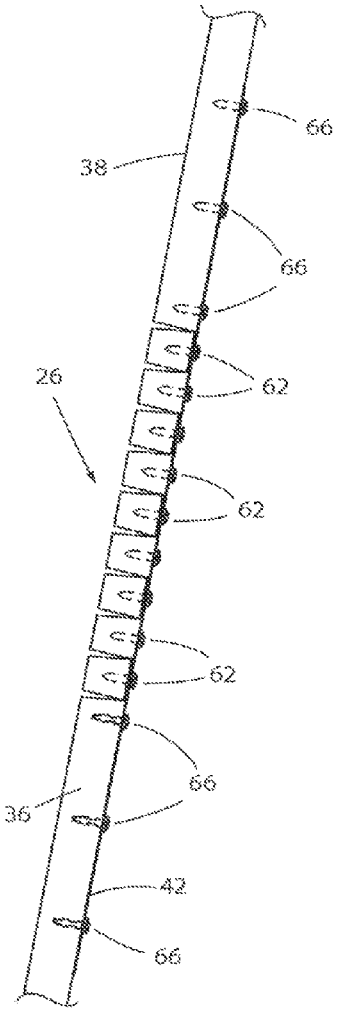
Figure 8A:
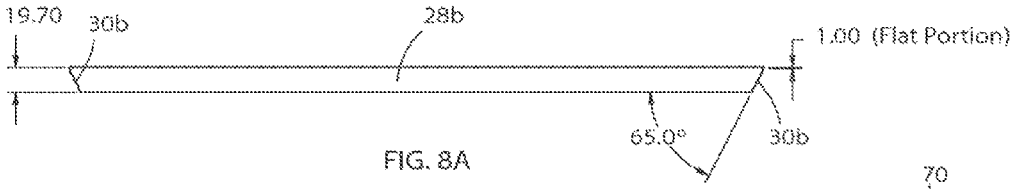
FIGS. 8A, 8B, and 8C show, respectively, side elevation, top plan, and end views of a beveled vertebral slat for use in the seat assembly.
Figure 8B:
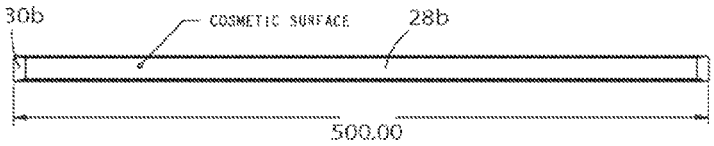
Figure 8C:
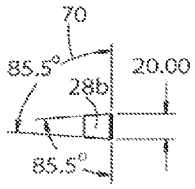

FIG. 6 is an exploded view of folding seat 10; FIGS. 7A and 7B show the construction and operation of seat assembly 24 in, respectively, the unfolded state of FIG. 1 and the folded state of FIG. 2; and FIGS. 8A, 8B, and 8C show several views of beveled vertebral slat 28*b* marked with preferred dimensions. With reference to FIGS. 1, 2, 6, 7A, 7B, 8A, 8B, and 8C, first and second spaced-apart spring bands 40 and 42 secure together, as a flexible unit, seat mount 36, vertebral column 26, and seat base 38, the last of which having a seat surface 44. A second or seat assembly foam layer 46 covers the surface area of seat assembly 24 and forms an interface layer between seat assembly 24 and seat back foam layer 22. Seat assembly foam layer 46 is bonded with adhesive or Velcro™ fabric hook and loop fastener material to seat base 38, and the portion of seat assembly foam layer 46 covering seat surface 44 provides a padded seat for an occupant. Seat assembly 24 is secured to seat back 12 by four bolts 50 (only one shown) passing through axially aligned holes 52 in seat mount 36, spacer blocks 54 set in aligned rectangular openings 56 in seat assembly foam layer 46 and seat back foam layer 22 (FIG. 6), and seat back 12 in the manner described below with reference to FIG. 6.

With particular reference to FIG. 6, folding seat 10 is assembled by first joining the component parts of seat assembly 24. This is accomplished by placing vertebral slats 28*b* and 28*c* alternately in lengthwise parallel alignment with their ends set even with one another to define for vertebral column 26 linear, discontinuous side margins along its length. Each of spring bands 40 and 42 has nine sets of two spaced-apart holes 60 that are located to receive screws 62 (FIGS. 7A and 7B) to hold vertebral slats 28*b* and 28*c* in the alignment configuration described above. Each of spring bands 40 and 42 has multiple sets of holes 64 through which screws 66 (FIGS. 7A and 7B) pass to secure the ends of spring bands 40 and 42 to seat mount 36 and seat base 38 to form seat assembly 24 as a flexible unit. The cross-sectional area of each of vertebral slats 28*b* and 28*c* defines a trapezoidal-shaped perimeter having nonparallel opposite sides of equal lengths. Each of the nonparallel sides is inclined at an 85.5° angle 70 (FIG. 8C) relative to the base of the trapezoid. Inclination angle 70 is set in cooperation with a 10° cant angle 72 (FIGS. 9A and 9B) of seat back 12 to establish a desired substantially horizontal, raised seat surface 44 for a seat occupant when folding seat 10 is in its folded state.

FIGS. 8A, 8B, and 8C show beveled vertebral slat 28*b* marked with preferred dimensions (in millimeters) and formed with beveled ends 30*b*. Corner vertebral slats 28*c* are of the same dimensions as those of beveled vertebral slats 28*b*, except that corner ends 30*c* form right angles relative to the base of the trapezoid. The alternating sequence of beveled slats 28 and corner slats 28*c* in vertebral column 26 prevents pinching of the seat occupant's fingers while folding seat 10 relaxes to its unfolded state.

With particular reference again to FIG. 6, four rectangular openings 56 of each of seat back foam layer 22 and seat assembly foam layer 46 are arranged in a rectangular pattern to receive corresponding rectangular spacer blocks 54 of the same height as the combined thicknesses of seat back foam layer 22 and seat assembly foam layer 46. Four bolts 50 pass through holes 52 in seat mount 36, spacer blocks 54, and seat back 12 to complete the assembly of folding seat 10. Two spaced-apart rubber feet 74 are inserted in the bottom end of seat mount 36 to prevent excessive wear of folding seat 10 when it is dragged across the surface of a floor during transportation to and from storage.

Figure 9C:
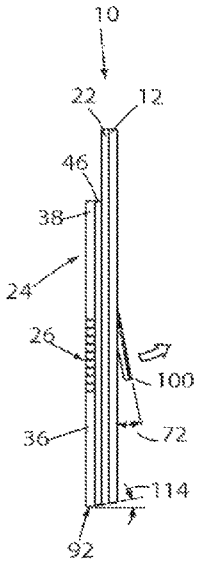
FIG. 9C shows the folding seat in its unfolded state of FIG. 9A and including a mounting member hinge-mounted to the seat back.
Figure 9A:
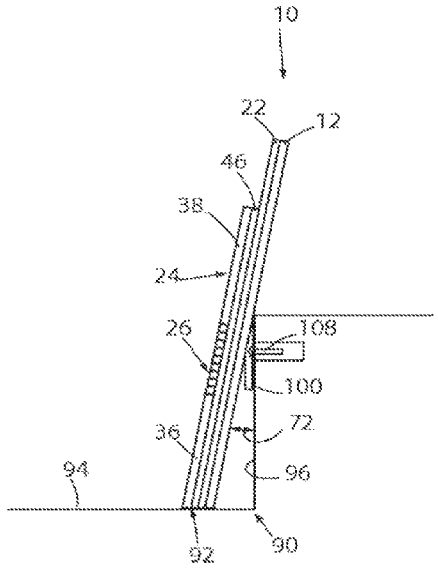
FIGS. 9A and 9B show, in its respective unfolded and folded states, the folding seat installed in a stadium or theater seating arrangement in which seats are installed on a stepped floor surface.
Figure 9B:
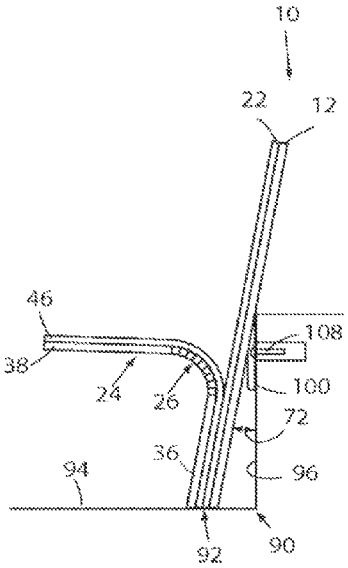

FIGS. 9A and 9B show, in its respective unfolded and folded states, folding seat 10 installed in a stadium or theater seating arrangement in which seats are installed on a stepped floor surface 90. A floor-contacting end 92 of folding seat 10 rests on a floor portion 94, and seat back mount surface 16 of seat back 12 is mounted to a riser 96. Skilled persons will appreciate that folding seat 10 can be installed in other tiered seating arrangements, such as, for example, in bleacher structures or on sloped floor surfaces.

With reference to FIGS. 4, 5, 9A, 9B, and 9C, a mounting member 100 extends at a 10° angle 72 relative to seat back mount surface 16 to mount folding seat 10 to riser 96 with seat back 12 inclined at a 10° cant angle. Mounting member 100 is preferably set at a fixed 10° angle 72. FIG. 9C shows a higher cost mounting alternative, in which mounting member 100 is hinge mounted to seat back 12 to permit mounting member 100 to pivot outwardly from a flush mount storage position in a recess (not shown) in seat back mount surface 16 to a 10° angle 72 operating position. Mounting member 100 has an L-shaped slot 102 with its longer segment 104 and its shorter segment 106 oriented, respectively, perpendicular and parallel to bottom end 20 of seat back 12. Folding seat 10 can be dropped downwardly toward floor portion 94 such that longer segment 104 of slot 102 receives a mounting screw 108 anchored in riser 96 and then moved horizontally along shorter segment 106 of slot 102 to releasably lock folding seat 10 in place. FIG. 2 shows in seat back foam layer 22 and seat back 12 an access hole 112 through which a screwdriver can be inserted to turn mounting screw 108 passing through mounting member 100 and into riser 96. FIG. 5 shows that longer segment 104 is offset from and the distal end of shorter segment 106 is aligned with a longitudinal center line 110 of seat back 12 so that, when folding seat 10 is locked in place, mounting screw 108 is positioned along center line 110. FIG. 4 shows folding seat 10 with floor-contacting end 92 inclined at a 10° bevel angle 114. Bevel angle 114 matches the 10° cant angle of seat back 12 and thereby causes folding seat 10, when installed, to rest level on floor portion 94. FIG. 9B shows folding seat 10, when installed and in its folded state, with a substantially horizontal, raised seat surface 44 on which a seat occupant can sit.

With particular reference to FIG. 6, FIGS. 7A and 7B, and FIGS. 9A and 9B, whenever no external force is applied to seat base 38 of seat assembly 24, spring bands 40 and 42 cause folding seat 10 to automatically assume at rest its unfolded state (FIGS. 7A and 9A), in which vertebral column 26 is substantially straight. FIG. 6 shows small magnets 116 set in recesses 118 in seat surface 44 and in seat back rest surface 14 of seat base 38 and seat back 12, respectively. Magnets 116 ensure that seat assembly 24 snaps shut and remains closed, i.e., seat mount 36 and seat base 38 lie in substantially the same plane, when folding seat 10 is unoccupied. Whenever a seat occupant pulls seat base 38 completely away from seat back 12 to present a raised, substantially horizontal sitting surface, folding seat 10 assumes its folded state (FIGS. 7B and 9B), in which vertebral column 26 is curved. Opening folding seat 10 applies to vertebral column 26 a bending force that closes the spaces between adjacent nonparallel sides of vertebral slats 28*b* and 28*c* and thereby squeezes adjacent vertebral slats 28*b* and 28*c* together to form a curved vertebral column 26. The weight of an occupant sitting on foam padded seat base 38 maintains the folded state of folding seat 10 as it supports the seat occupant.

Preferred materials used in the construction of folding seat 10 include 13-ply baltic birch plywood for seat back 12, vertebral slats 28*b* and 28*c*, seat mount 36, and seat mount 38; spring steel for spring bands 40 and 42; and urethane foam material for seat back foam layer 22 and seat assembly foam layer 46.

Figure 10A:
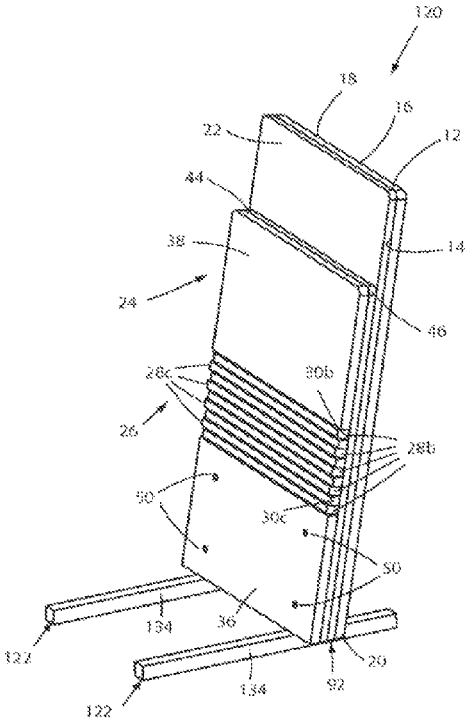
FIGS. 10A and 10B are isometric views of the folding seat of FIGS. 1 and 2, configured in an alternative embodiment as a freestanding chair shown in, respectively, an unfolded state and a folded state.
Figure 10B:
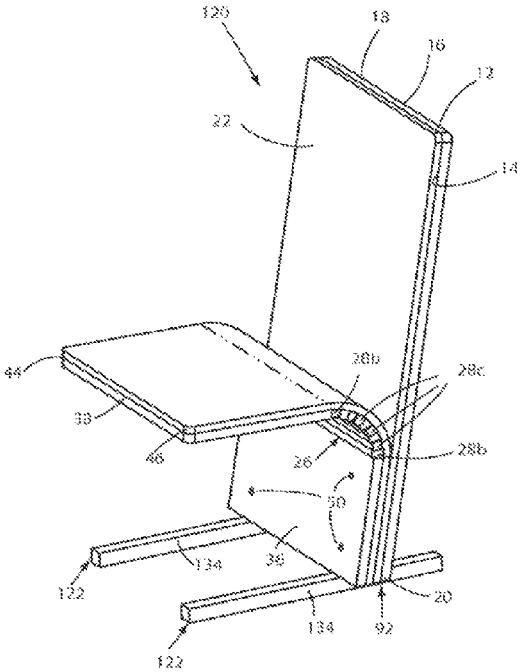
Figure 11A:
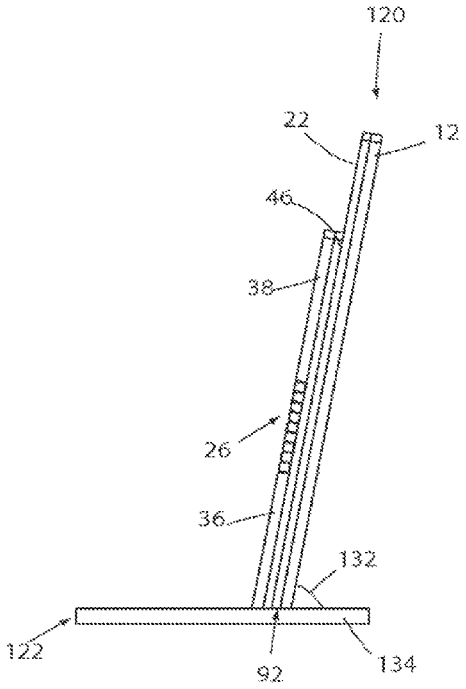
FIGS. 11A and 11B are side elevation views of the freestanding chair of FIGS. 10A and 10B, respectively.
Figure 11B:
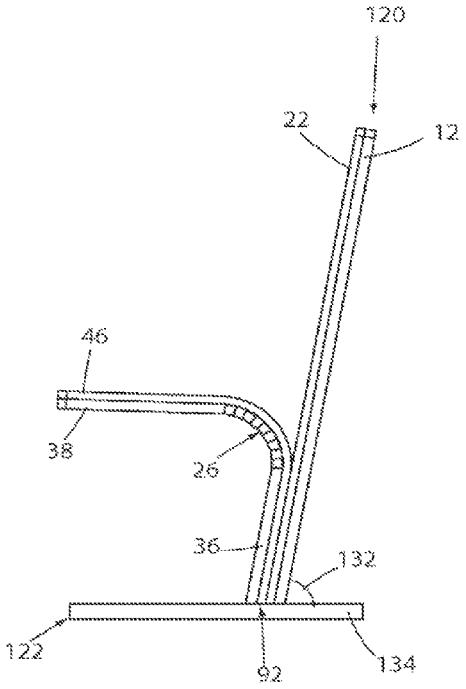
Figure 12:
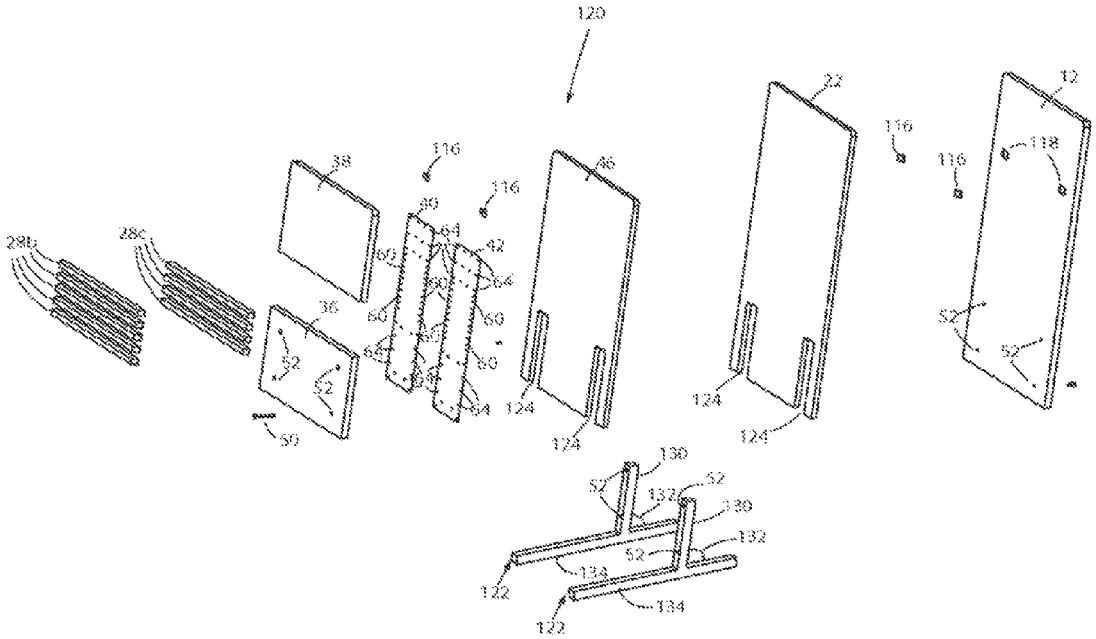
FIG. 12 is an exploded view of the freestanding chair of FIGS. 10A and 10B, showing modifications of a seat back foam layer and a seat assembly foam layer of the folding seat for accommodating chair leg sets to thereby form the freestanding chair.

FIGS. 10A and 10B are isometric views of folding seat 10, configured in an alternative embodiment as a freestanding chair 120 shown in, respectively, an unfolded state and a folded state. FIGS. 11A and 11B are side elevation views of freestanding chair 120 in, respectively, its unfolded state and its folded state. FIG. 12 is an exploded view of freestanding chair 120, showing the addition of two similar chair leg sets 122 to and modifications of seat back foam layer 22 and seat assembly foam layer 46 of folding seat 10 to accommodate chair leg sets 122 and thereby form freestanding chair 120.

With reference to FIGS. 10A, 10B, 11A, 11B, and 12, the component parts of folding seat 10 and freestanding chair 120 are the same, except for substitution of chair leg sets 122 for spacer blocks 54 and substitution of two slots 124 for different pairs of rectangular openings 56. With particular reference to FIG. 12, each of chair leg sets 122 has an upright portion 130 extending from and positioned at an 80° angle 132 relative to a floor support portion 134. Upright portion 130 has the same height and width as the height and width of spacer blocks 54 and includes two holes 52 positioned so that bolts 50 pass through them during assembly of the chair. Rectangular openings 56 in seat back foam layer 22 and seat assembly foam layer 46 are replaced by slots 124 that extend into foam layers 22 and 46 from their respective bottom ends and cover a distance equal to the length of upright portions 130. Upright portions 130 fit into slots 124, and bolts 50 passing through holes 52 secure chair leg sets 122 in place to form freestanding chair 120.

Figure 13:
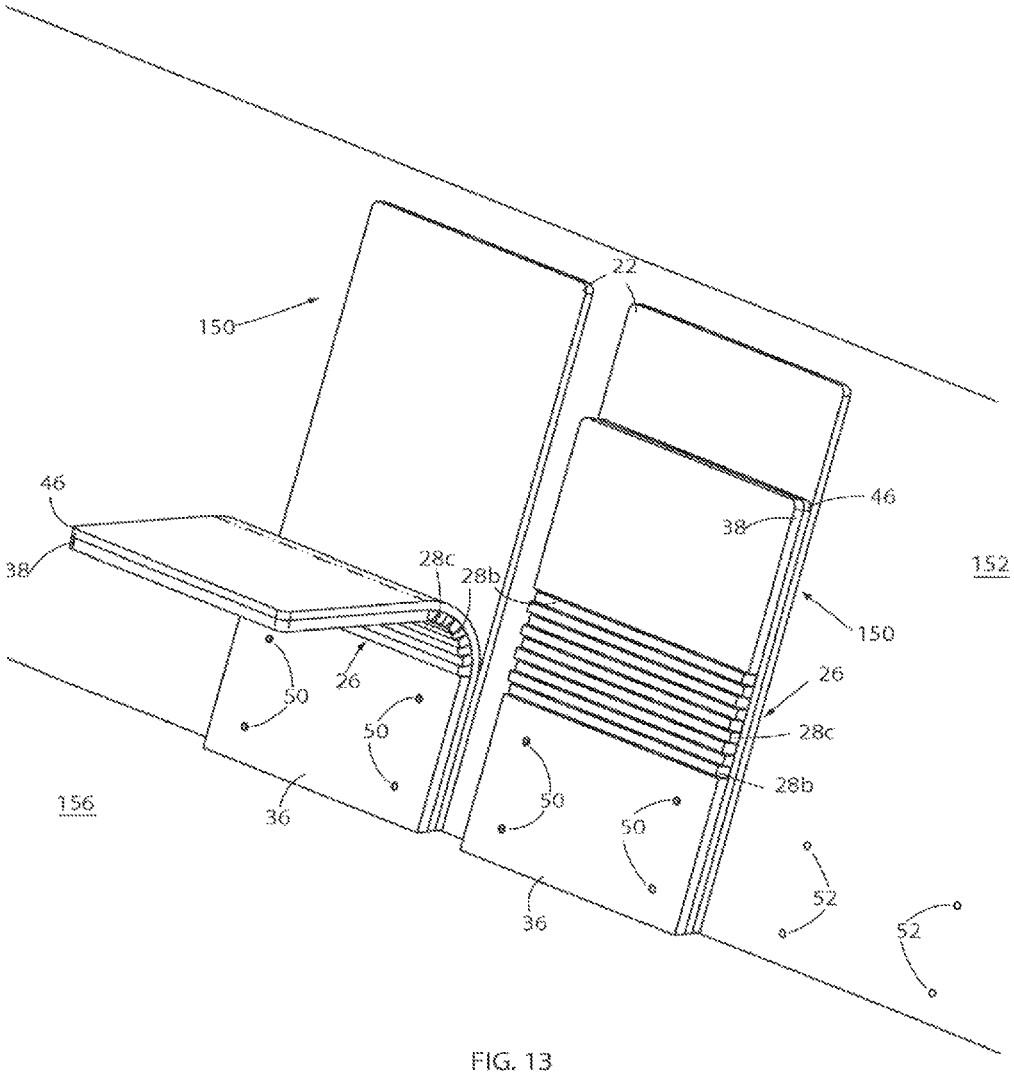
FIG. 13 is a perspective view of the frontal portions of two side-by-side wall-mounted folding seats, the left-side seat shown in a folded state and the right-side seat shown in an unfolded state.
Figure 14A:
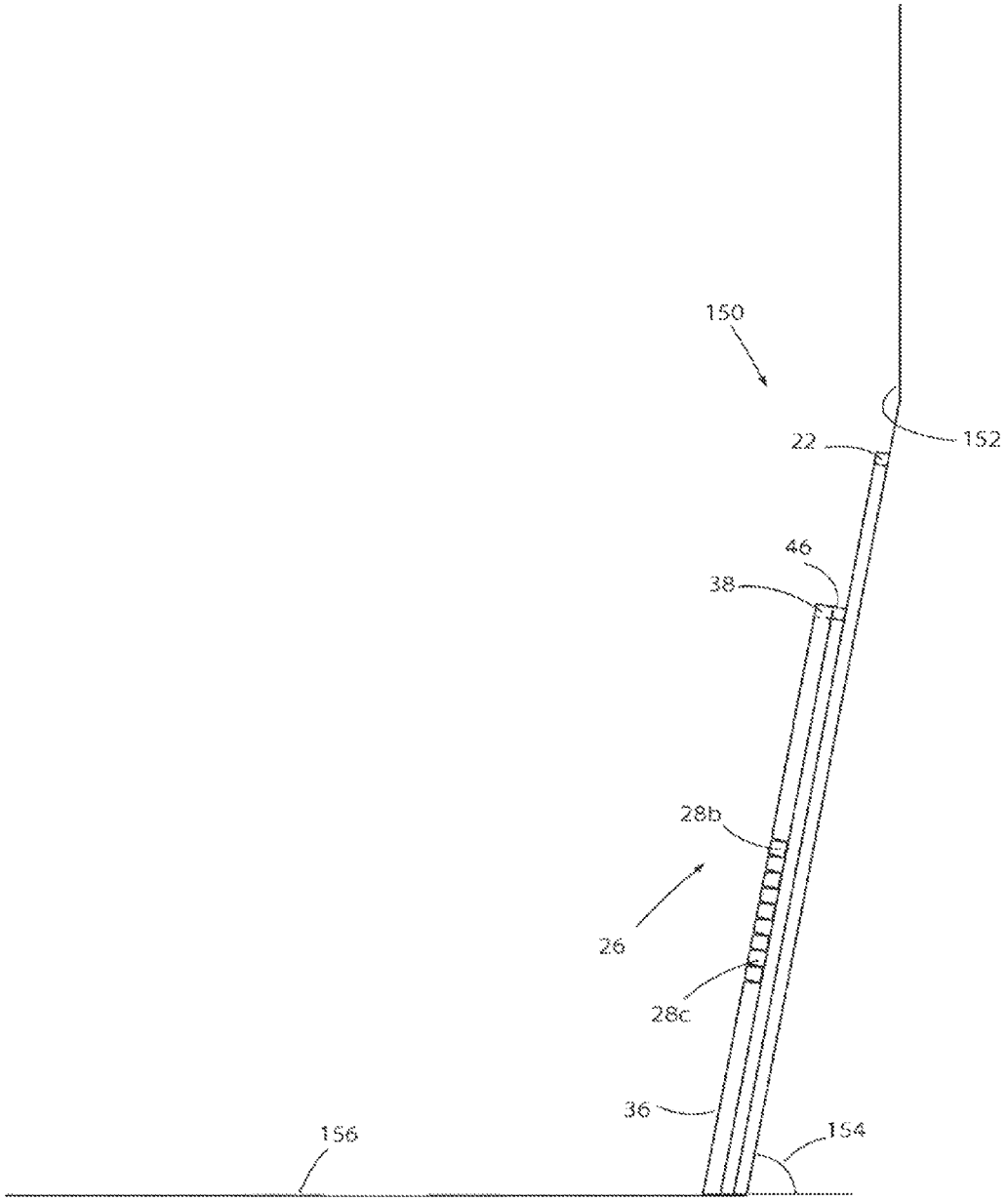
FIGS. 14A and 14B are side elevation views of the wall-mounted folding seat of FIG. 13 shown in, respectively, its unfolded state and its folded state.
Figure 14B:
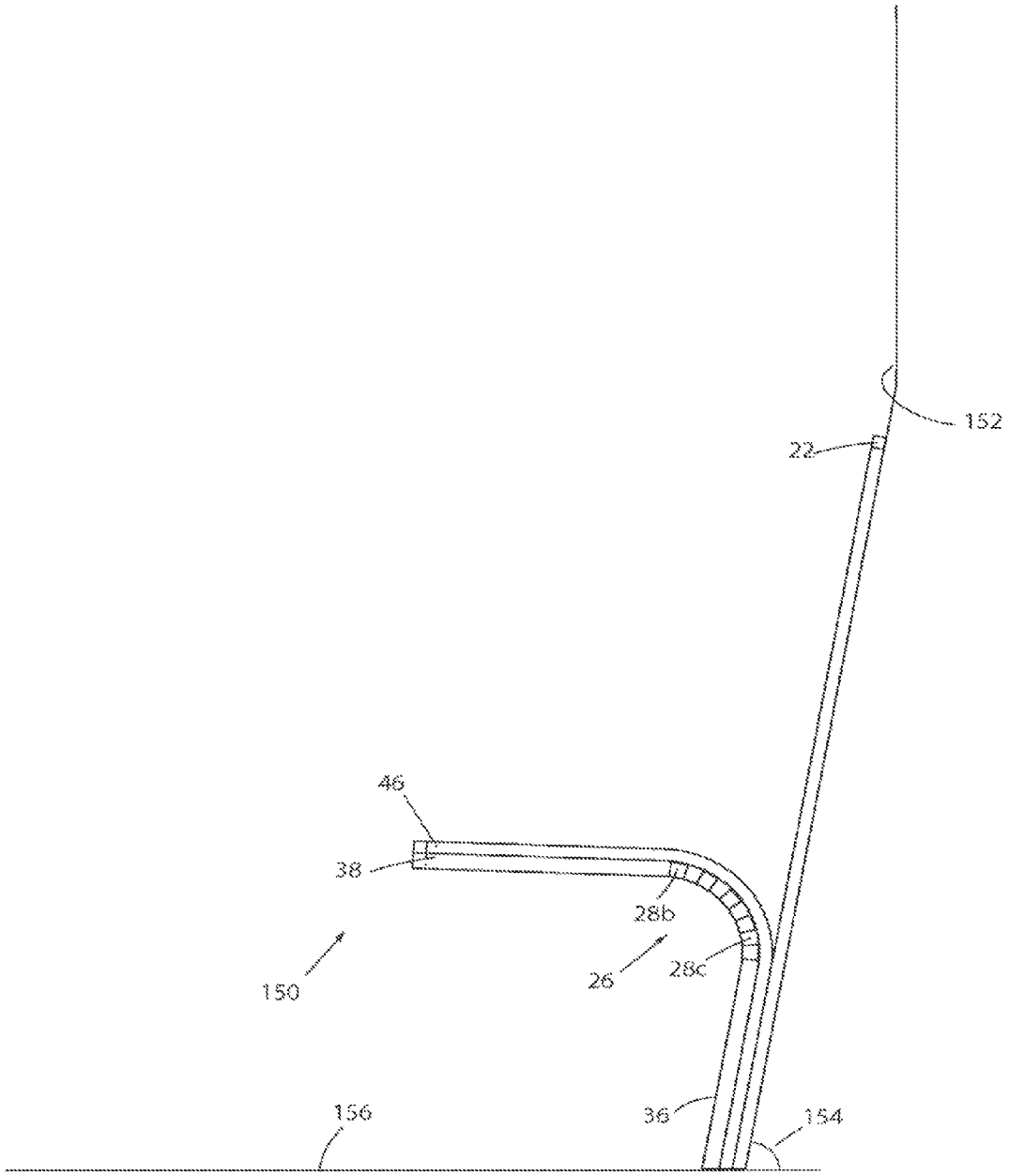

FIG. 13 is a perspective view of the frontal portions of two side-by-side wall-mounted folding seats 150, one of which (left side) shown in a folded state and the other of which (right side) shown in an unfolded state. FIGS. 14A and 14B are side elevation views of wall-mounted folding seat 150 in, respectively, its unfolded state and its folded state. With reference to FIGS. 13, 14A, and 14B, the component parts of folding seat 10 and wall-mounted folding seat 150 are the same, except for substitution of an inclined wall surface 152 as a common seat back of one or a row of multiple folding seats for a separate seat back 12. Wall surface 152 is inclined at an 80° angle 154 relative to a floor 156. Wall-mounted folding seat 150 is useful for installation in public transportation vehicles (e.g., subway car) or any other application in which compact, flat seat storage would be of benefit. When wall-mounted folding seat 150 is installed, seat back foam layer 22 rests against wall "I" surface 152. Bolts 50 pass through holes 52 drilled at predetermined locations in wall surface 152, as shown in FIG. 13.

Figure 15:
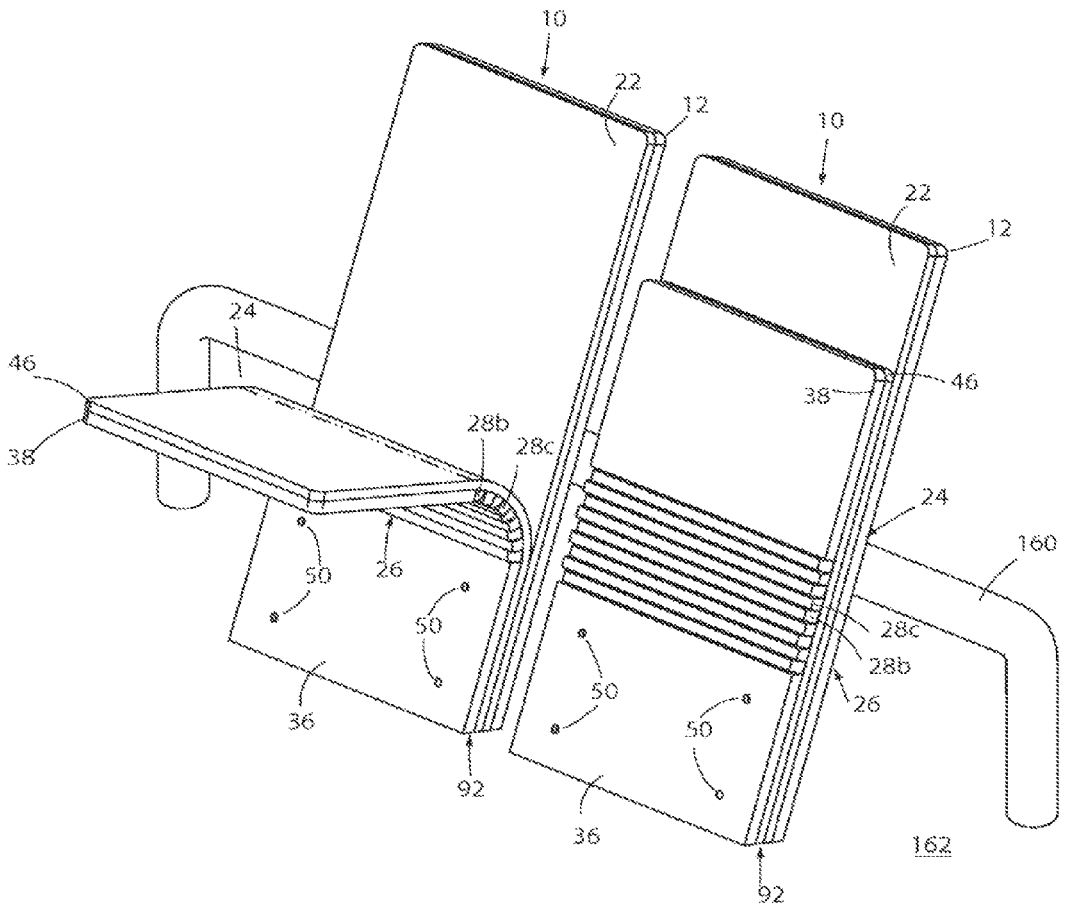
FIG. 15 is a perspective view of the frontal portions of two side-by-side floor-mounted folding seats, the left-side seat shown in a folded state and the right-side seat shown in an unfolded state.

FIG. 15 is a perspective view of the frontal portions of two side-by-side floor-mounted folding seats 10, one of which (left side) shown in a folded state and the other of which (right side) shown in an unfolded state. With reference to FIG. 15, folding seats 10 are inclined at a 10° cant angle 72 in similar manner to that shown in FIGS. 9A and 9B and fastened to an inverted U-shaped railing 160 that is anchored to a floor 162. Each of floor-mounted seats 10 can be secured to railing 160 by passing mounting screw 108 through mounting member 100 and a threaded hole (not shown) provided in the horizontal section of railing 160.

Figure 16:
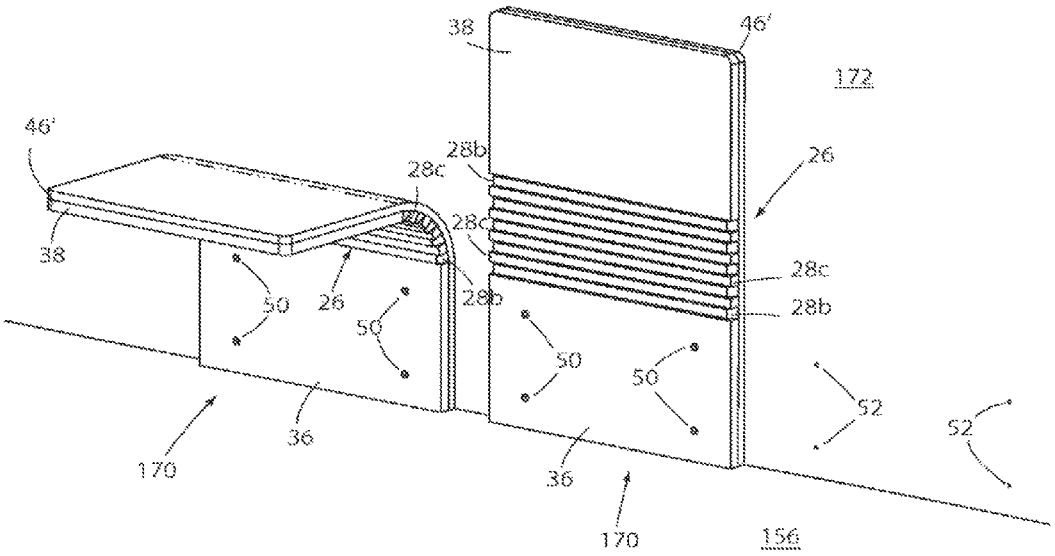
FIG. 16 is a perspective view of the frontal portions of two side-by-side wall-mounted folding tables, the left-side table shown in a folded state and the right-side table shown in an unfolded state.
Figure 17A:
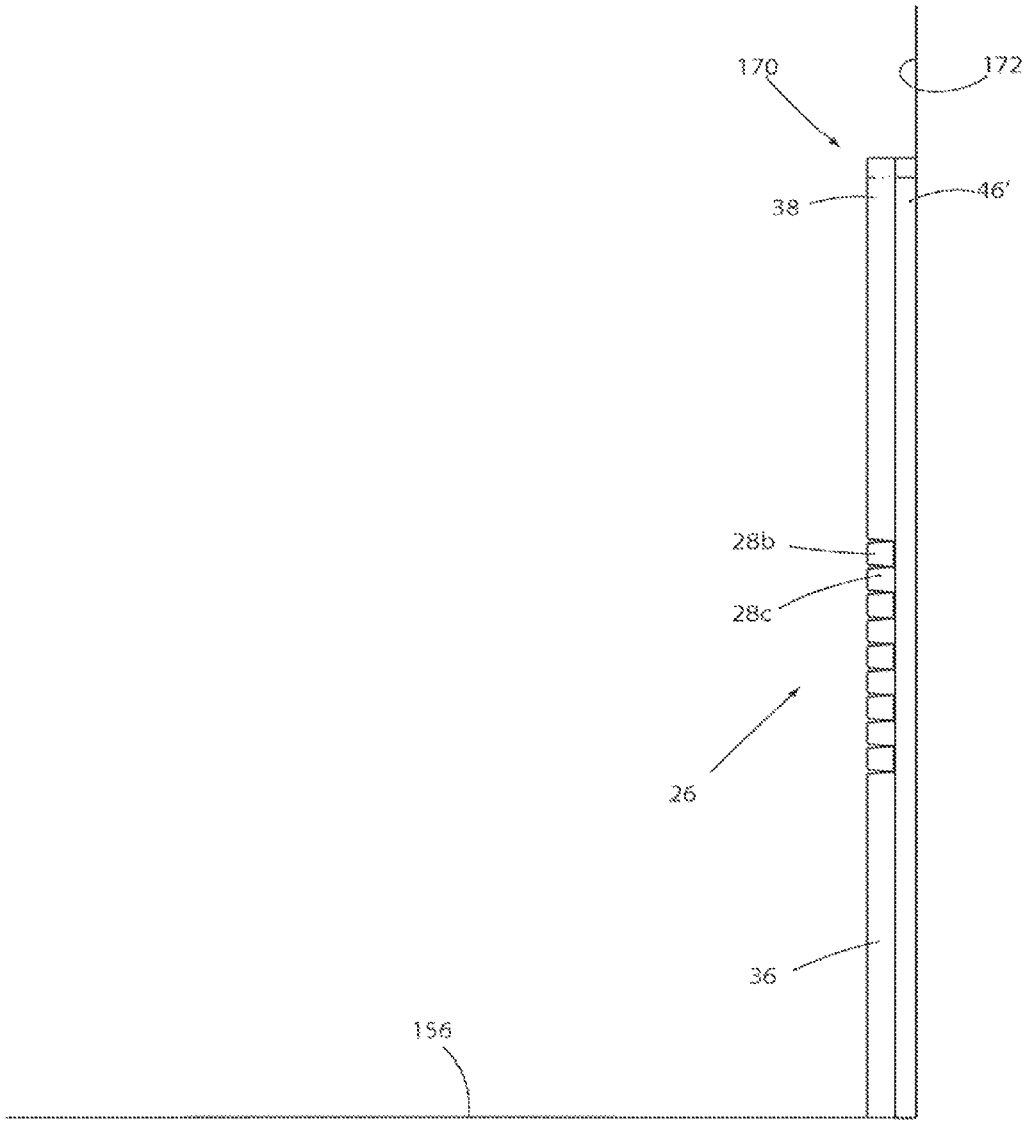
FIGS. 17A and 17B are side elevation views of one wall-mounted folding table of FIG. 16 shown in, respectively, its unfolded state and its folded state.
Figure 17B:
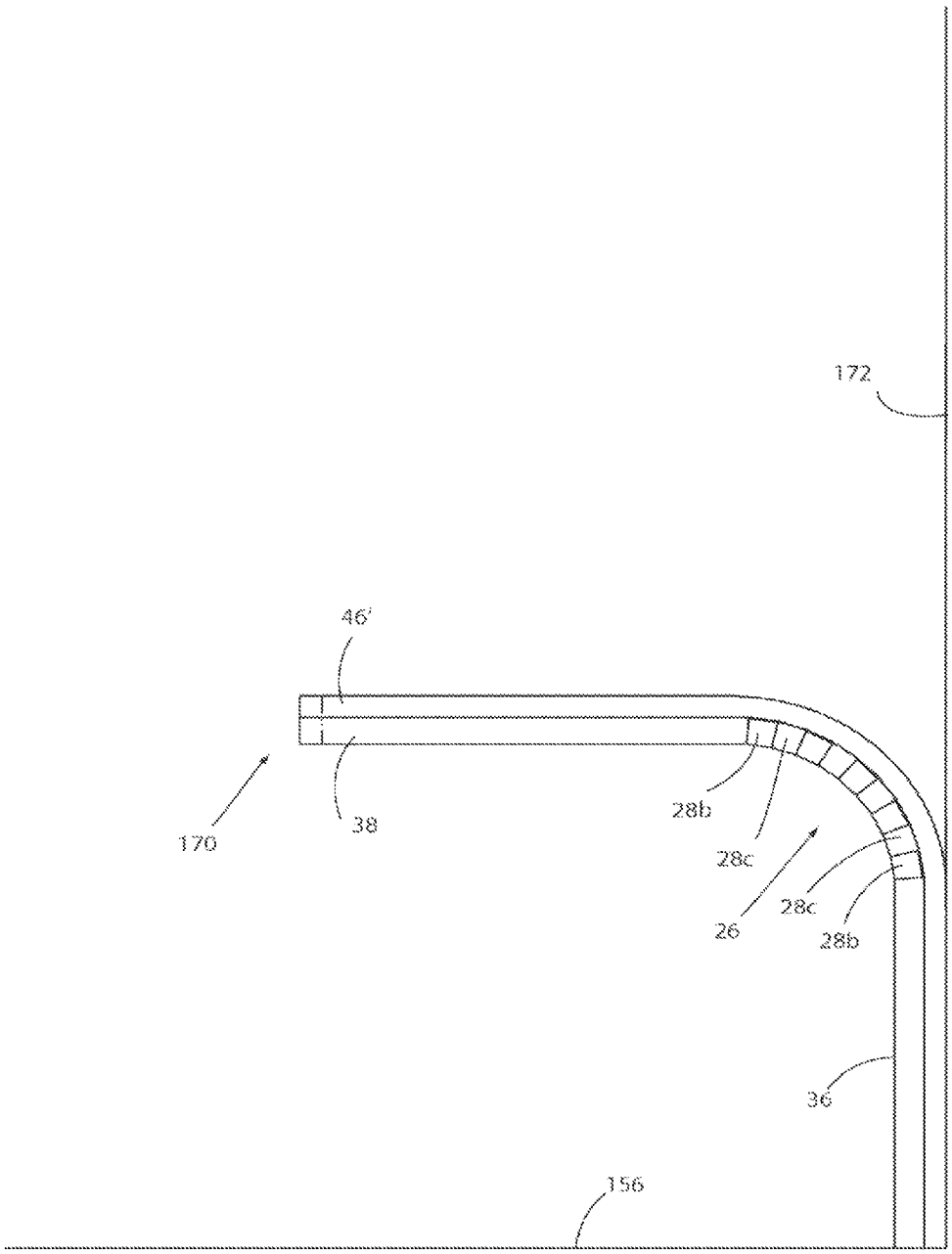

FIG. 16 is a perspective view of the frontal portions of two side-by-side wall-mounted folding tables 170, one of which (left side) shown in a folded state and the other of which (right side) shown in an unfolded state. FIGS. 17A and 17B are side elevation views of one wall-mounted folding table 170 in, respectively, its unfolded state and its folded state. With reference to FIGS. 16, 17A, and 17B, the component parts of wall-mounted folding seat 150 and wall-mounted folding table 170 are the same, except for substitution of a flexible, uncushioned table (i.e., hard table top) surface layer 46' for seat assembly foam layer 46 and a wall surface 172 as a mounting surface of folding table 170 for a separate seat back 12 and its corresponding seat back foam layer 22. Wall surface 172 is oriented at a 90° angle relative to floor 156, in a conventional arrangement. Wall-mounted folding table 170 is useful for installation in an office furniture system (e.g., a work space cubicle divider wall) or any other application in which compact, flat table storage would be of benefit. When wall-mounted folding table 170 is installed, table surface layer 46' rests against wall surface 172. Bolts 50 pass through holes 52 drilled at predetermined locations in wall surface 172, as shown in FIG. 16. Wall-mounted folding table 170 can be constructed to remain in the folded state while supporting no or a light-weight object by use of a heavy weight or weighted table base 38 or by selection for spring bands 40 and 42 a material having a sufficiently low spring constant. Magnets 116 could be used to keep wall-mounted folding table 170 in the unfolded state.

Figure 18A:
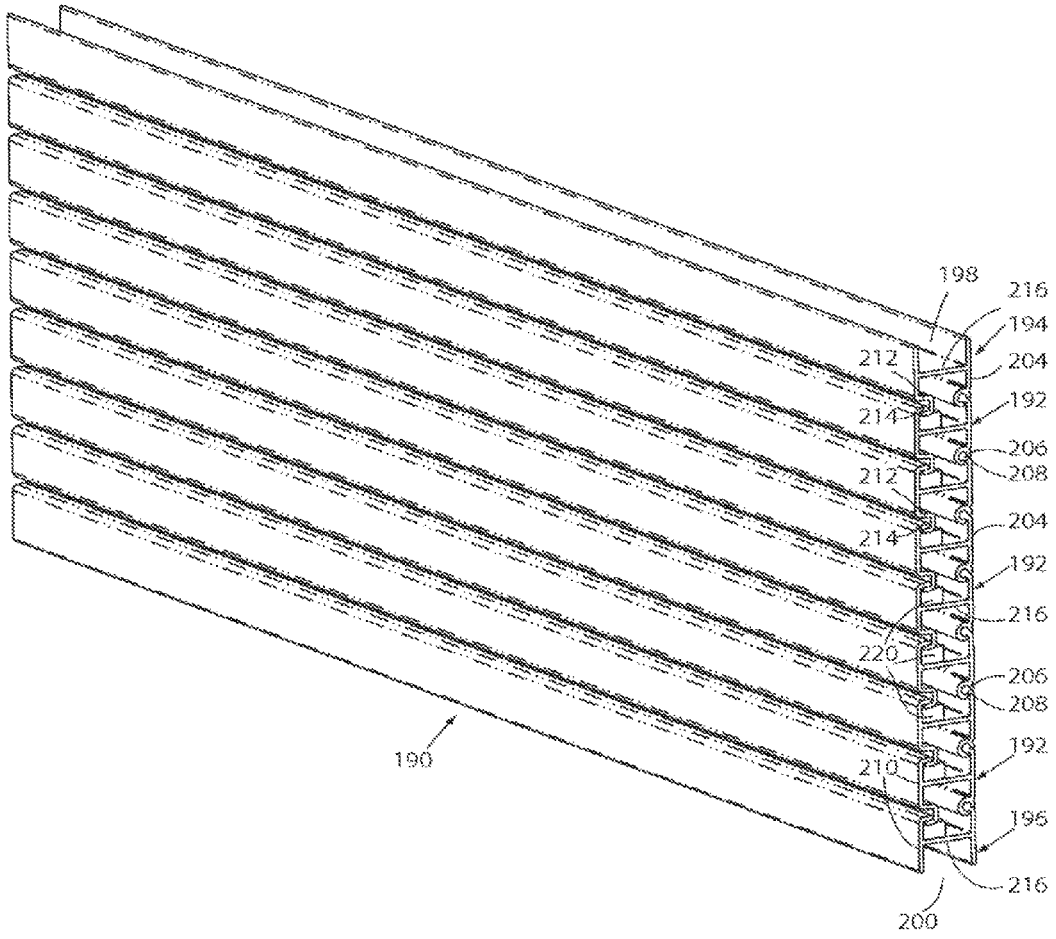
FIGS. 18A and 18B and FIGS. 19A and 19B are pairs of isometric and end views showing a first alternative embodiment of a vertebral column in, respectively, a straightened, relaxed configuration corresponding to an unfolded state of a folding seat, and in a curved configuration corresponding to the folded state of a folding seat.
Figure 18B:
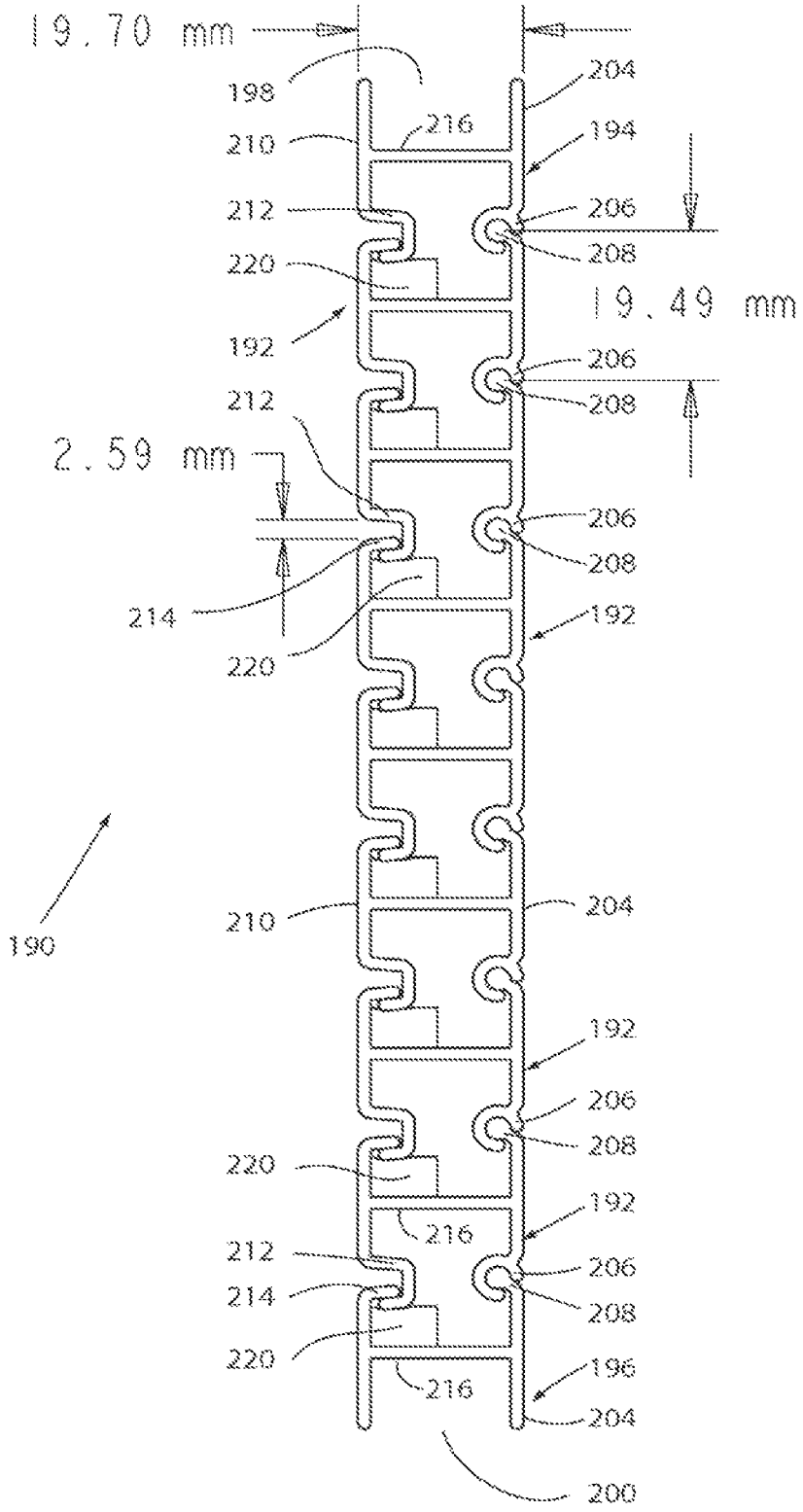
Figure 19A:
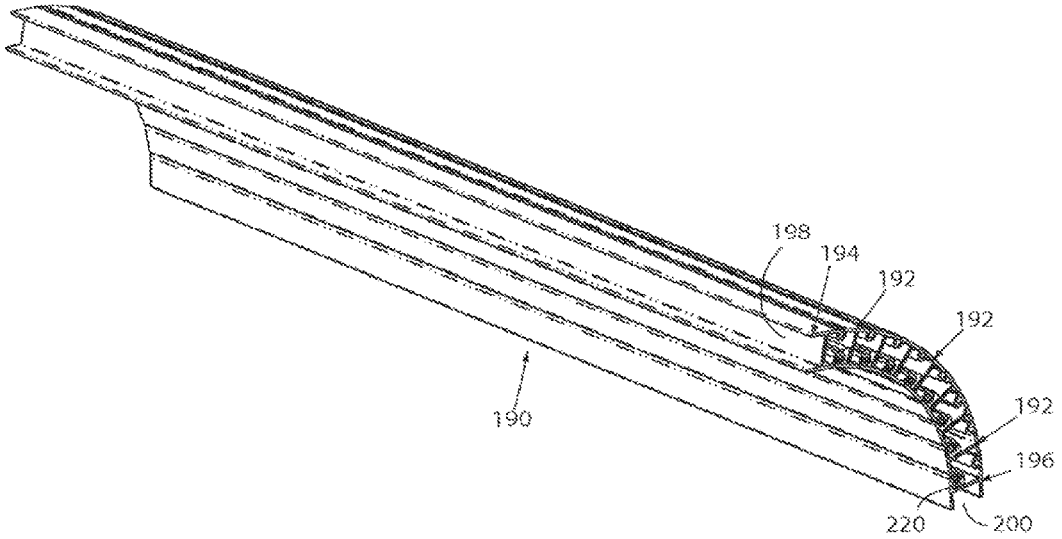
Figure 19B:
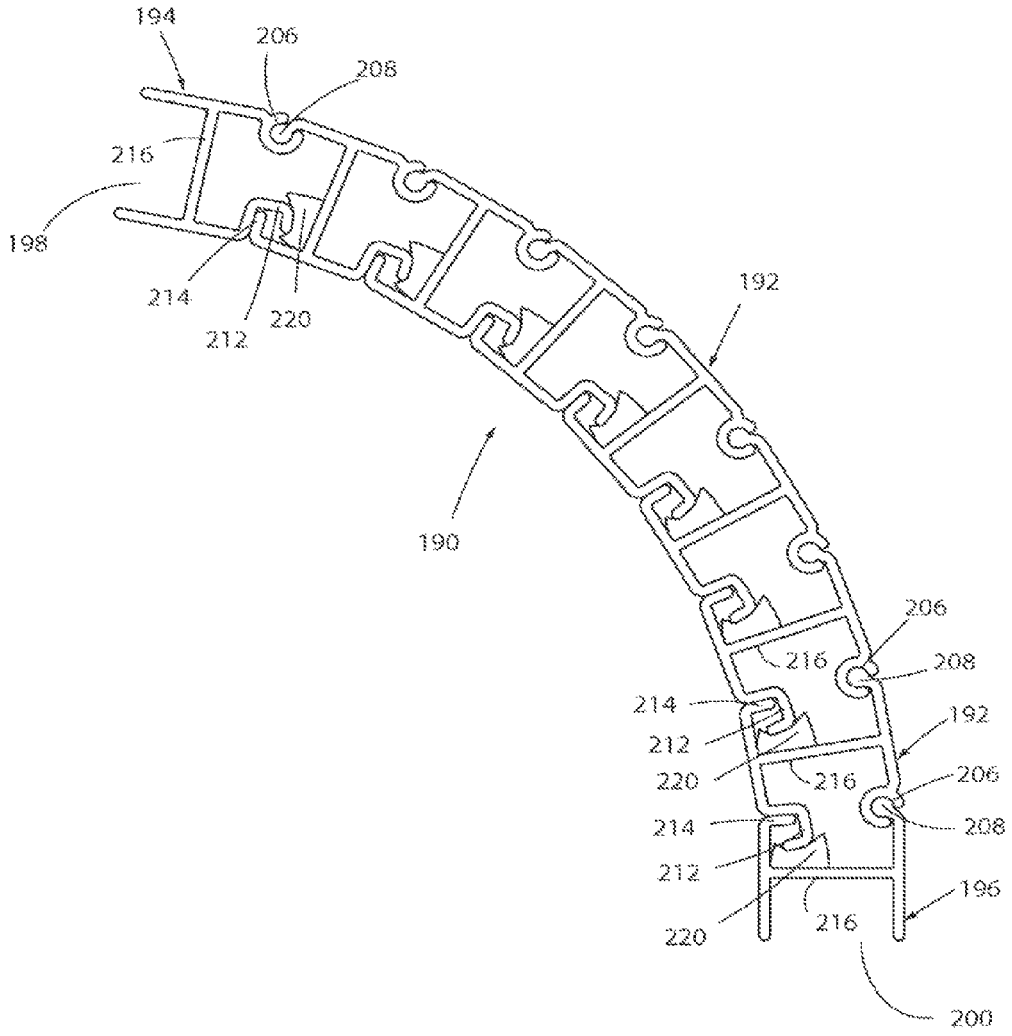

FIGS. 18A and 18B and FIGS. 19A and 19B are pairs of isometric and end views of a vertebral column 190, which constitutes a first alternative embodiment of a vertebral column assembled with individual vertebral links interconnected by web sections confining expansion foam slats to form an integral distributed spring mechanism. FIGS. 18A and 18B show vertebral column 190 in a straightened, relaxed configuration, and FIGS. 19A and 19B show vertebral column 190 in a curved configuration assumed in response to an externally applied bending force. With reference to FIGS. 18A, 18B, 19A, and 19B, vertebral column 190 includes nine parallel-aligned vertebral links, seven of which are interior vertebral links 192 of nominally the same size and shape and two of which are end-coupling vertebral links 194 and 196. End-coupling vertebral links 194 and 196 are of the same size and shape of interior vertebral links 192, except for formation of the respective U-shaped free ends 198 and 200 sized to receive different ones of seat mount 36 and seat (or table) base 38. Each interior vertebral link 192 has on opposite sides and extending along its length two sets of complementary structures configured to interlock with corresponding complementary structures of next adjacent vertebral links 192. End-coupling vertebral links 194 and 196 have on the sides opposite their respective free ends 198 and 200 structures configured to interlock with corresponding complementary structures of the next adjacent interior vertebral links 192. The entire assembly of nine vertebral links forms articulating adjoining vertebral links.

Figure 20A:
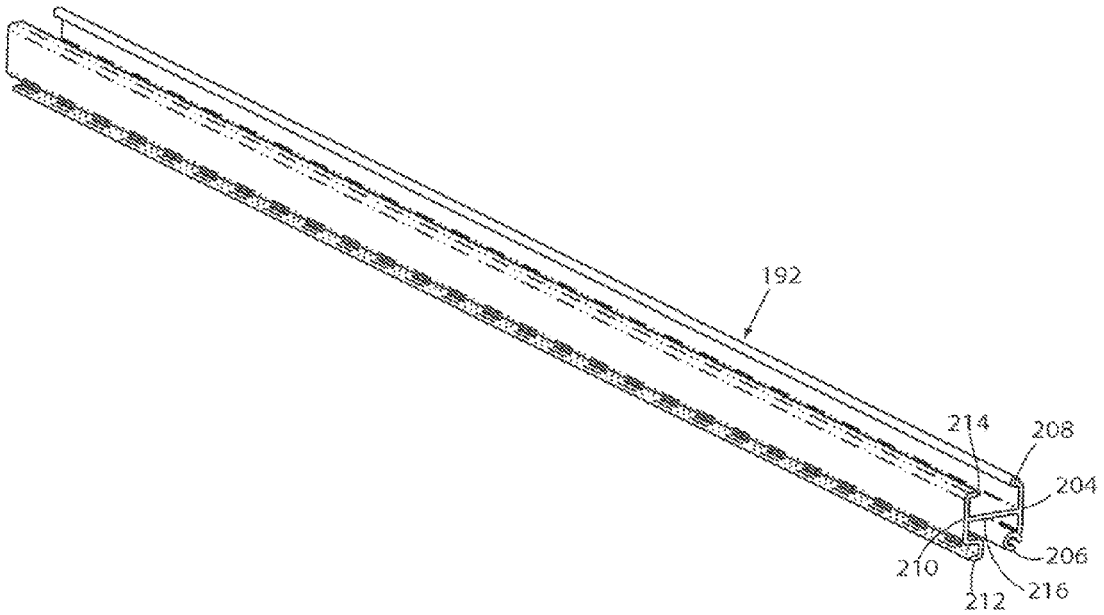
FIGS. 20A and 20B are respective isometric and end views showing one interior vertebral link of the first alternative embodiment of the vertebral column.
Figure 20B:
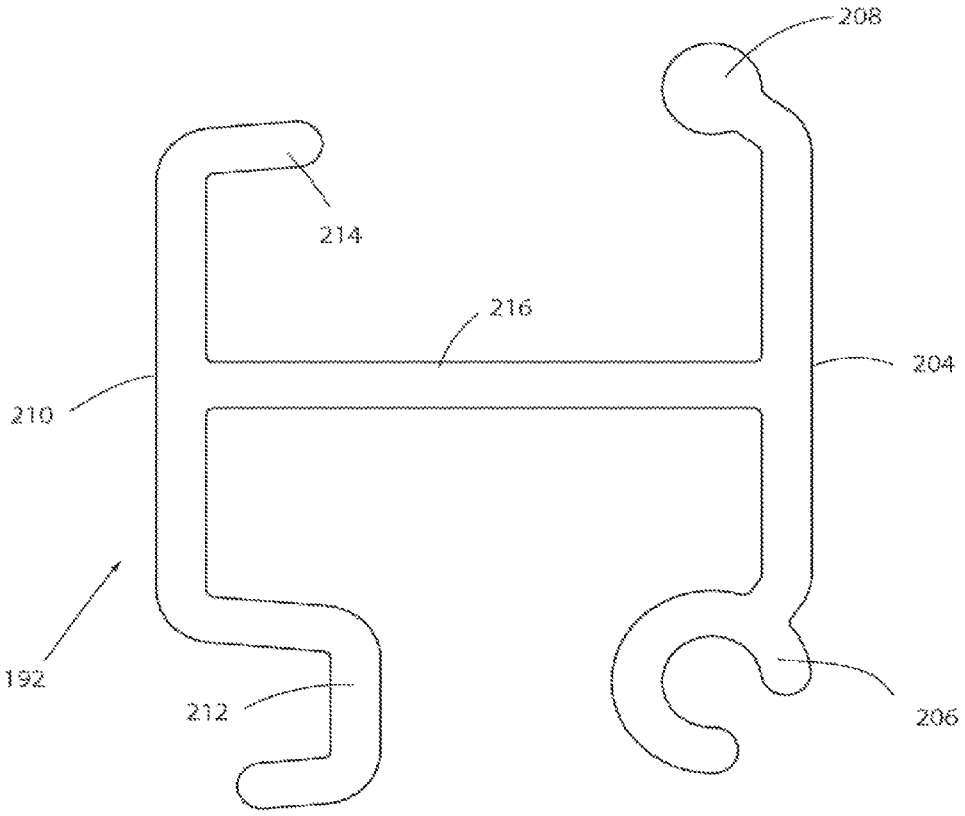

FIGS. 20A and 20B are respective isometric and end views of one interior vertebral link 192, which is of I-beam shape with different structural features at its four lateral ends. Interior vertebral link 192 has on a seat side member 204 a first set of interlocking structures including an open-end hinge sleeve 206 and a pivot 208 and on an underside member 210 a second set of interlocking structures including a hooked end 212 and a rolled edge 214. A web 216 interconnects seat side member 204 and underside member 210. FIGS. 18A and 18B show end-coupling vertebral link 194, on its seat side member 204, open-end hinge sleeve 206 of the first set and, on its underside member 210, hook and 212 of the second set. FIGS. 18A and 18B also show end-coupling vertebral link 196, on its seat side member 204, pivot 208 of the first set and, on its underside member 210, rolled edge 214 of the second set. Vertebral links 192, 194, and 196 are preferably made of extruded aluminum.

Figure 21A:
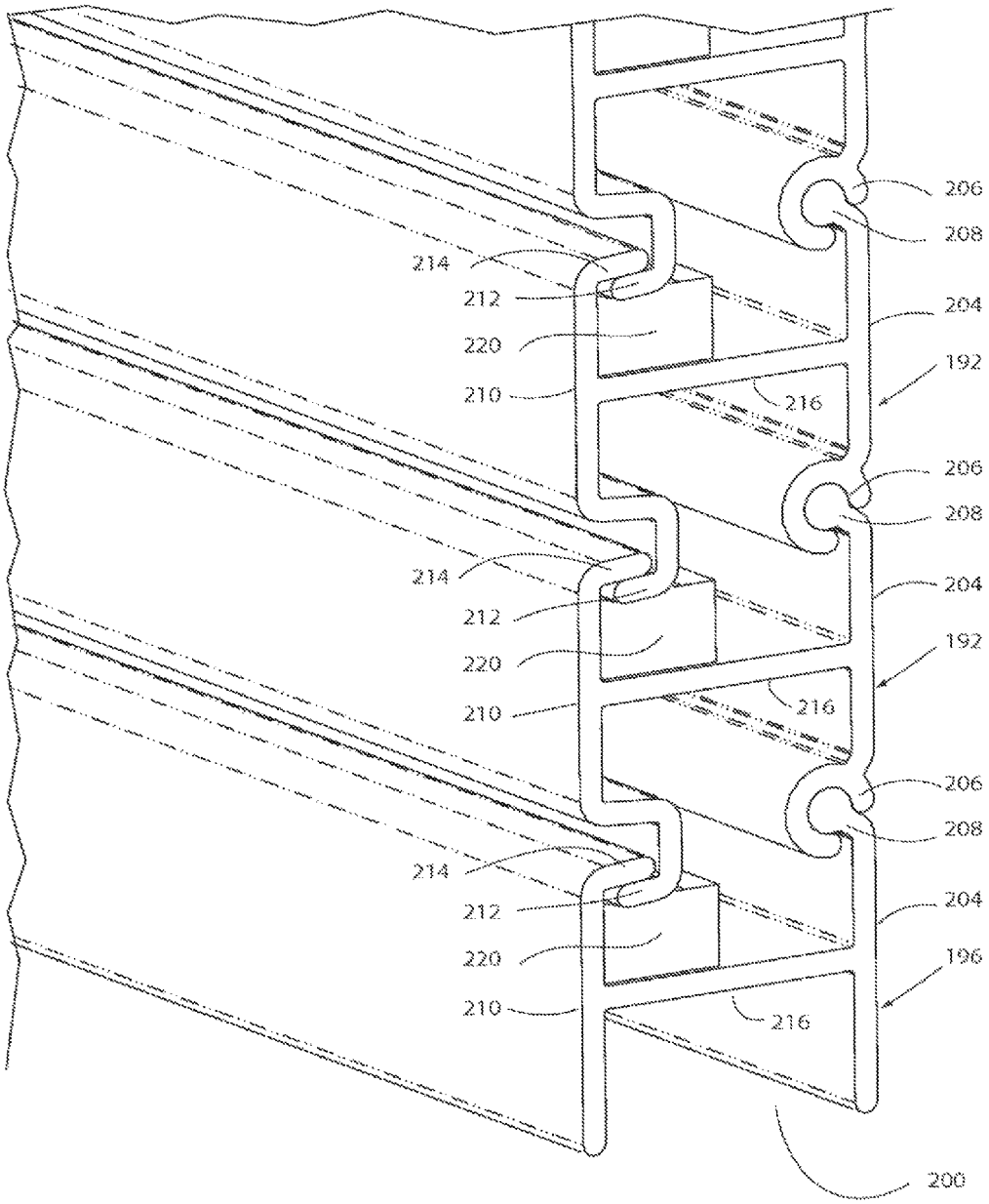
FIGS. 21A and 21B and FIGS. 22A and 22B are pairs of enlarged fragmentary respective isometric and end views showing in detail the interconnection of multiple vertebral links of the first alternative embodiment of the vertebral column in, respectively, the straightened configuration of FIGS. 18A and 18B, and in the curved configuration of FIGS. 19A and 19B.
Figure 21B:
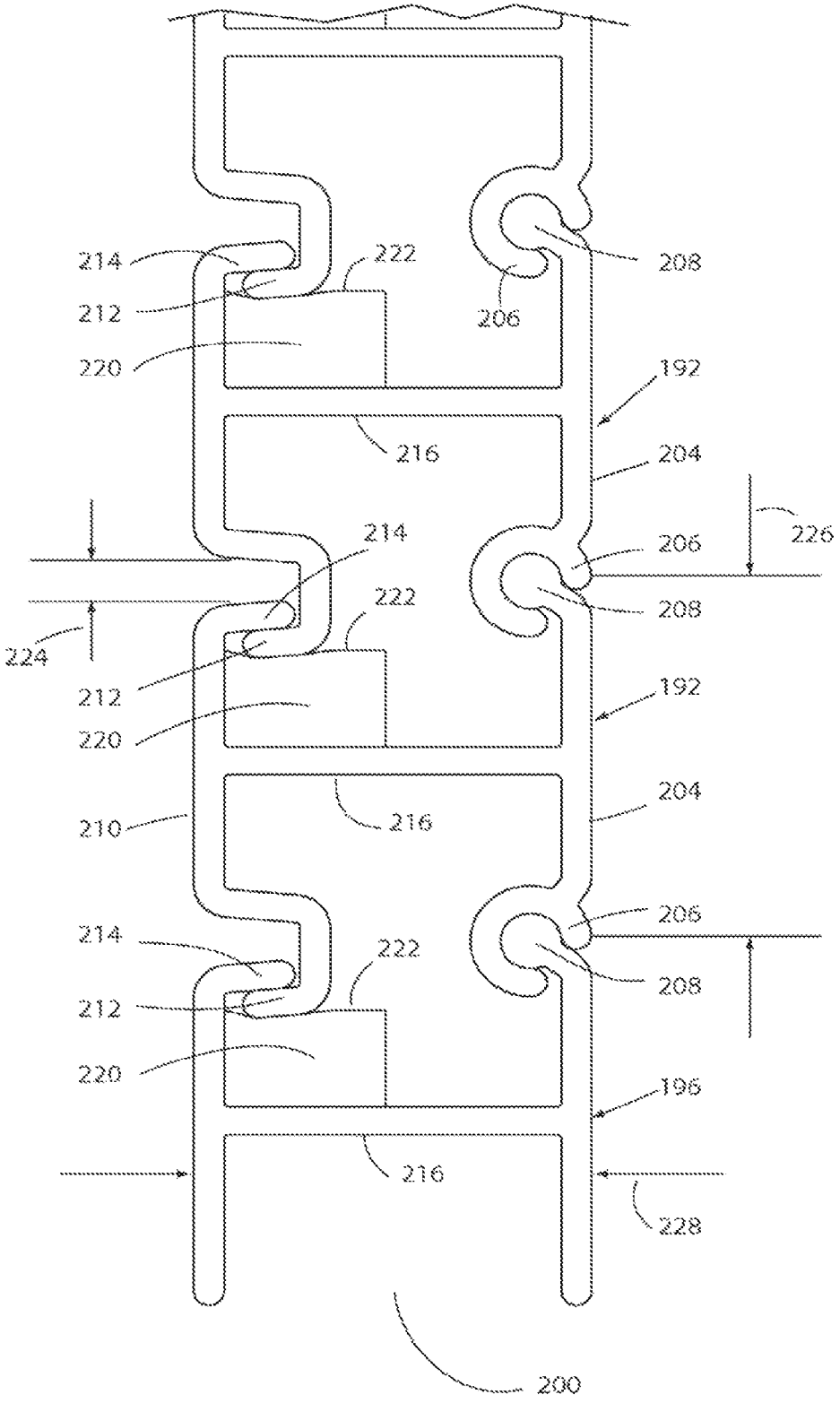
Figure 22A:
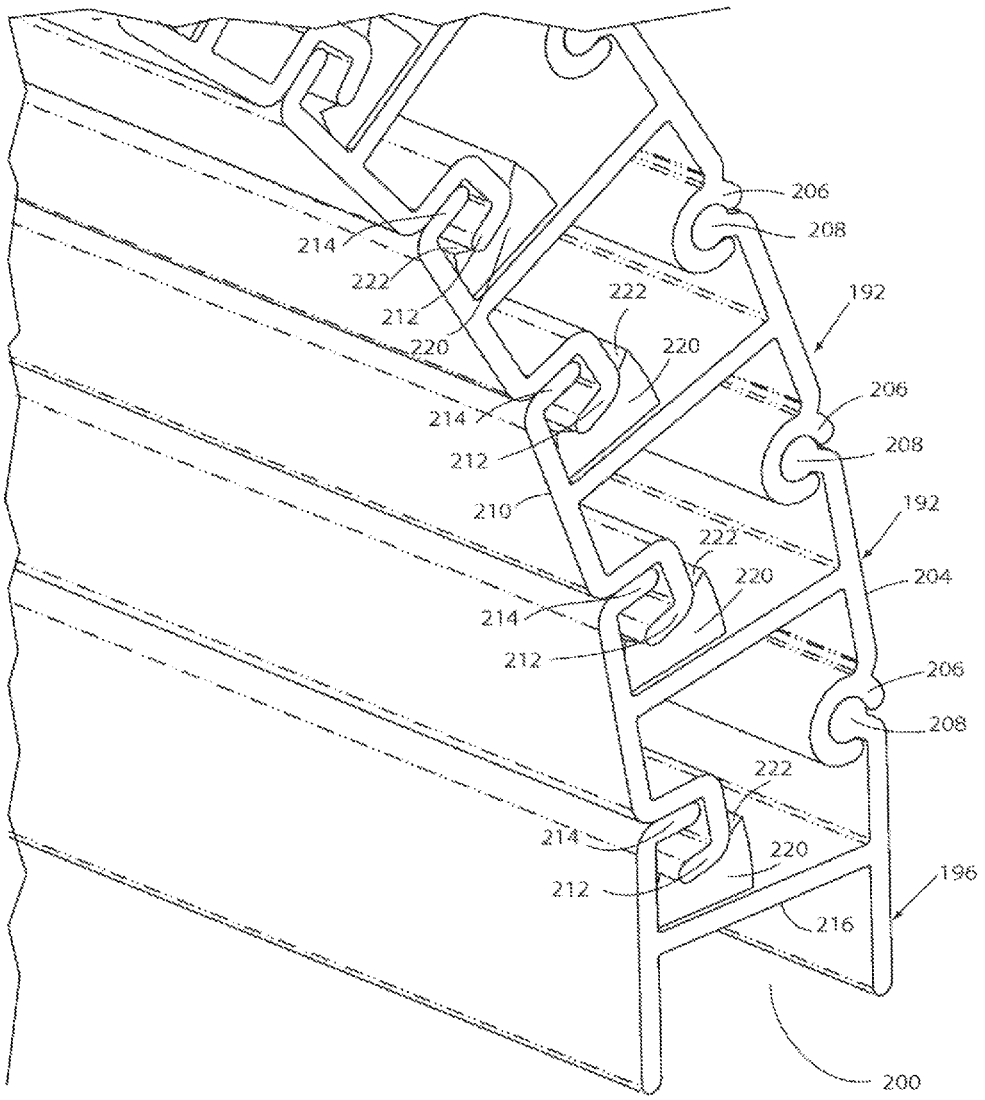
Figure 22B:
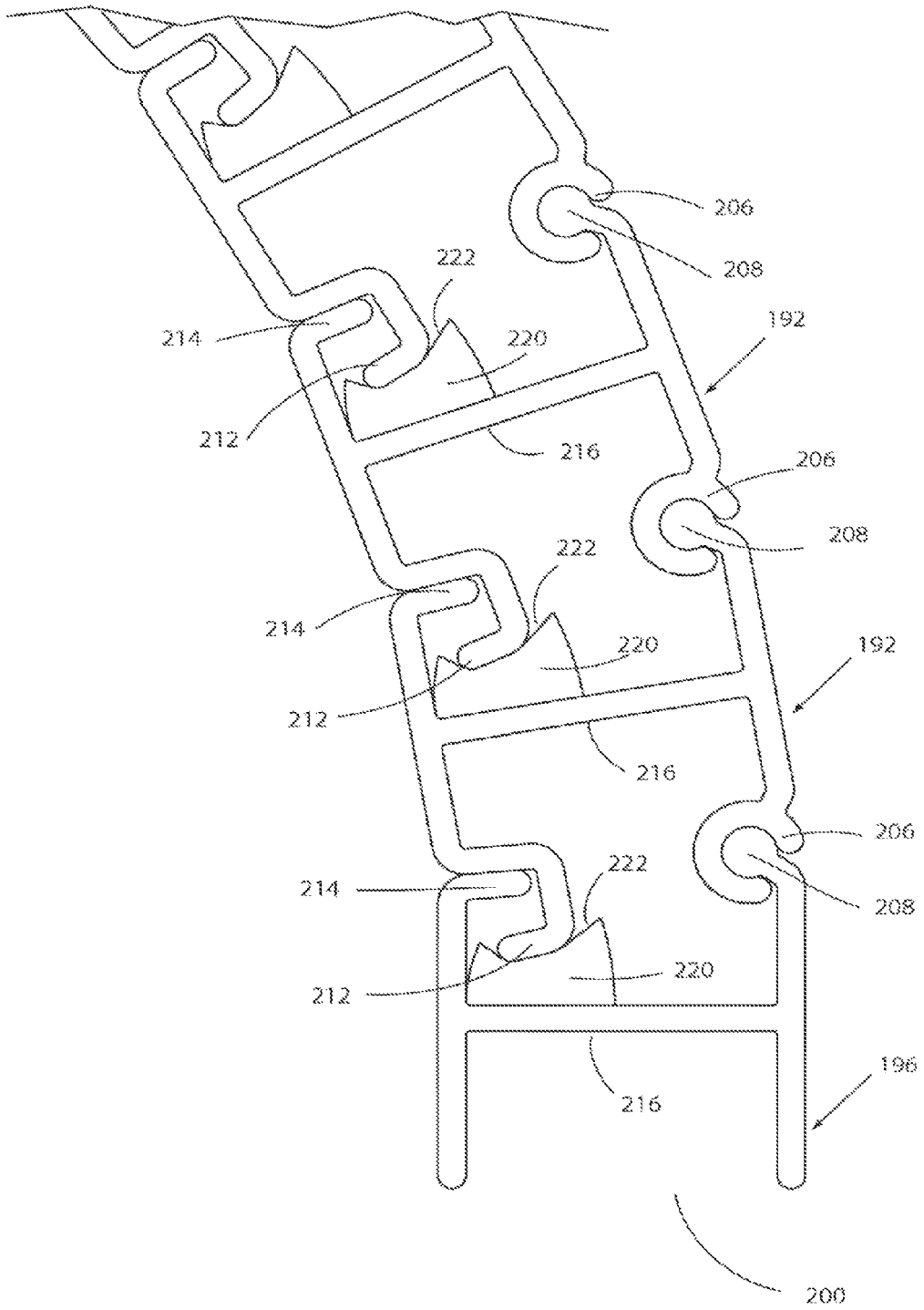

FIGS. 21A and 21B and FIGS. 22A and 22B are pairs of enlarged fragmentary isometric and end views showing in detail the interconnection of multiple vertebral links to form vertebral column 190 of articulating adjoining vertebral links 192 and 196. Each pair of adjacent vertebral links is pivotally joined by engagement of pivot 208 in hinge sleeve 206 and by compression of rolled edge 214 against hooked end 212 by an expansion foam or elastomeric slat 220 positioned between and contacting hooked end 212 and web 216. Elastomeric slat 220 is preferably made of polyurethane foam of appropriate durometer and is of rectangular cross-sectional shape when at rest, i.e., before insertion between hooked end 212 and web 216 of adjacent vertebral links. Hinge sleeves 206 and pivots 208 arranged in alternating succession and each adjacent hinge sleeve 206 and pivot 208 connected to each other constitute interlocking articulating structures of vertical column 190 that establish its curvature. FIGS. 21A and 21B show vertebral column 190 in a straightened configuration corresponding to the unfolded state of folding seat 10, and FIGS. 22A and 22B show vertebral column 190 in a curved configuration corresponding to the folded state of folding seat 10.

FIGS. 21B and 22B show elastomeric slats 220 exhibiting deformed, concave surfaces 222 that function as bearing surfaces against which hook ends 212 rest. Concave surfaces 222 change shape in response to changing compressive forces imparted by hook ends 212 so as to permit them to remain in place while complying with the different amounts of curvature of vertebral column 190 as it bends between the unfolding and folding states of folding seat 10. Elastomeric slats 220 urge vertebral column 190 to its straightened configuration by inherent restorative forces of elastomeric slats 220 urging their return to a nominal rectangular shape in the absence of externally applied compressive forces during unfolding of folding seat 10. If vertebral column 190 is used in the construction of wall-mounted table 170, elastomeric slats 220 may be formed of softer (i.e., lower durometer) material to decrease its resistance to deformation and thereby cause wall-mounted table 170 to remain in the folded state when no object rests on the table surface.

FIG. 21B shows the vertebral link dimensions and separation distances of adjoining vertebral links that establish for vertebral column 190 the progressive incremental angular displacements of pivots 208 interlocked within their associated hinge sleeves 206 to achieve the straightened configuration shown in FIG. 18B (unfolded state of folding seat 10) and the curved configuration of FIG. 19B (folded state of folding seat 10). With reference to FIG. 21B, hooked end 212 and rolled edge 214 interlocked in the straightened configuration are separated by a distance 224 of 2.59 mm. A center-to-center distance 226 of open-end hinge sleeve 206 and pivot 208 of the first set of interlocking structures on underside member 210 of each interior vertebral link 192 is 19.7 mm. The width of vertebral column 190 is a distance 228 of 19.7 mm between the outer surfaces of seat side member 204 and underside member 210 of each of vertebral links 192, 194, and 196. FIG. 22B shows the complete closure of separation distance 224 and resulting contact between interlocked hooked end 212 and rolled edge 214 in the folded state of folding seat 10.

FIGS. 23A and 23B and FIGS. 24A and 24B are pairs of isometric and end views of a vertebral column 190', which constitutes a second alternative embodiment of a vertebral column assembled with individual vertebral links interconnected by web sections confining expansion foam slats to form an integral distributed spring mechanism. The component parts of vertebral column 190 and vertebral column 190' are the same, except for a modification of one of the first set of interlocking structures that decouples them and substitution of a larger rectangular elastomeric slat 220' that fits between webs 216 of adjacent vertebral links. The views of vertebral column 190 and its components shown in FIGS. 18A and 18B, FIGS. 19A and 19B, FIGS. 20A and 20B, FIGS. 21A and 21B, and FIGS. 22A and 22B correspond to the views of vertebral column 190' and its components shown in the respective FIGS. 23A and 23B, FIGS. 24A and 24B, FIGS. 25A and 25B, FIGS. 26A and 26B, and FIGS. 27A and 27B. Similar components and structural features are identified by common reference numerals, and corresponding, modified components and features are identified by the same reference numerals followed by primes.

Figure 23A:
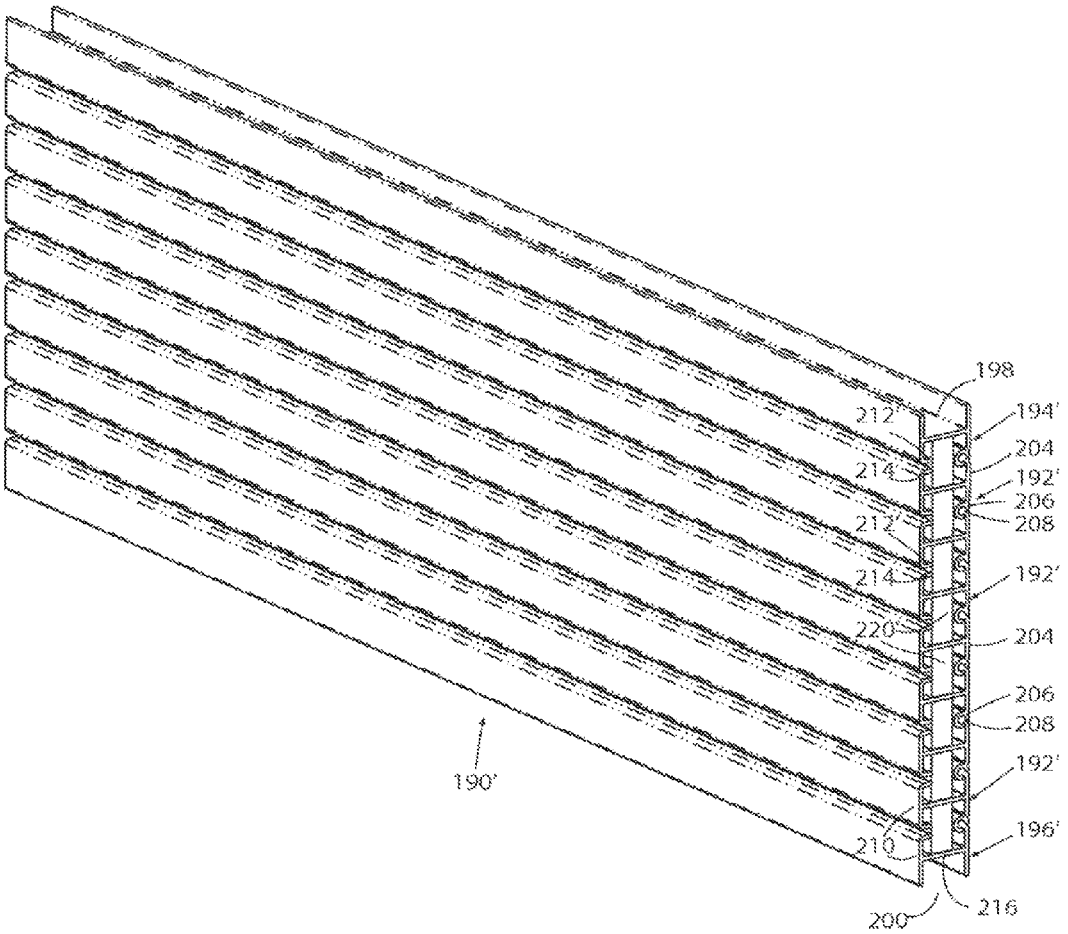
FIGS. 23A and 23B and FIGS. 24A and 24B are pairs of isometric and end views showing a second alternative embodiment of a vertebral column in, respectively, a straightened, relaxed configuration corresponding to an unfolded state of a folding seat, and in a curved configuration corresponding to a folded state of a folding seat.
Figure 23B:
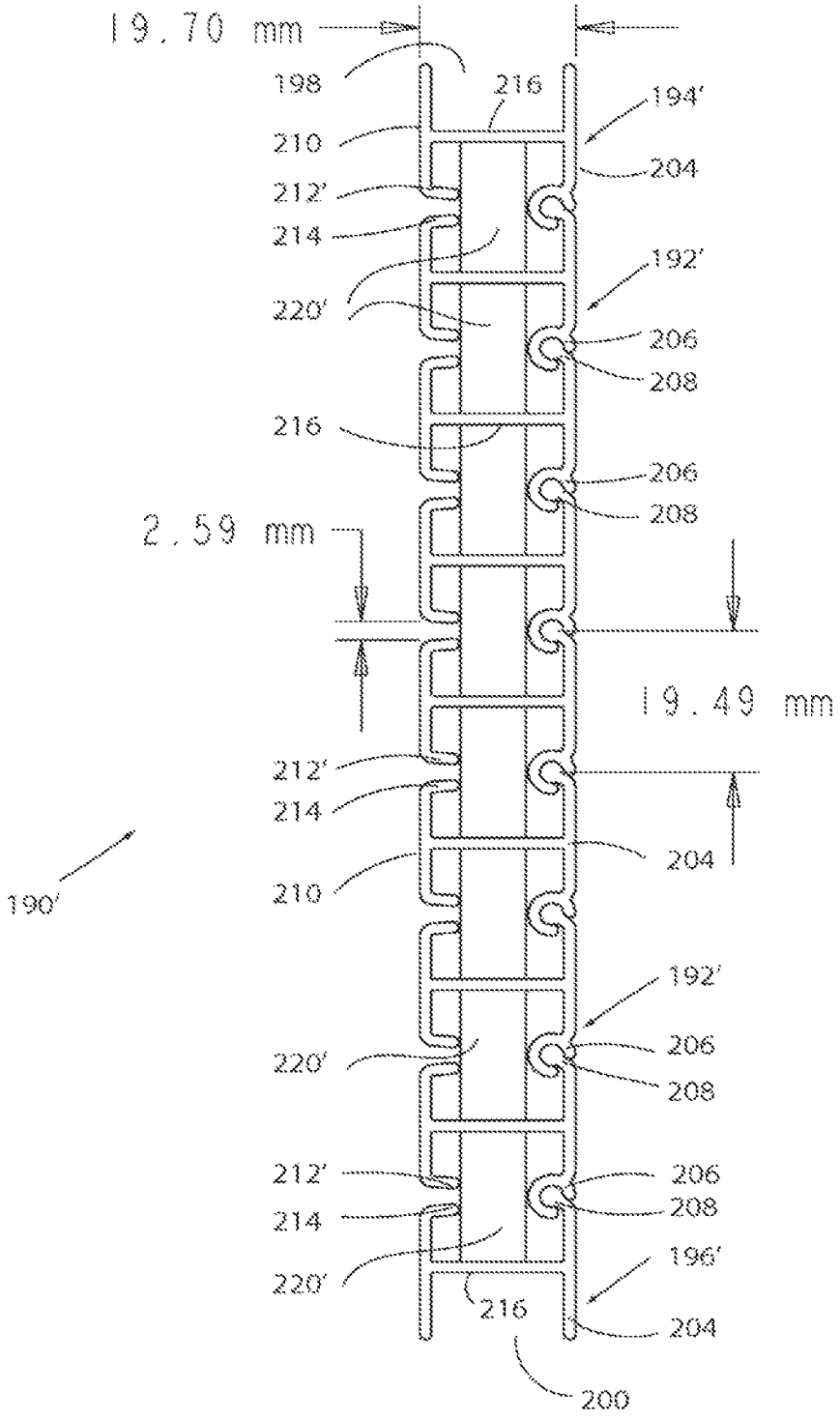
Figure 24A:
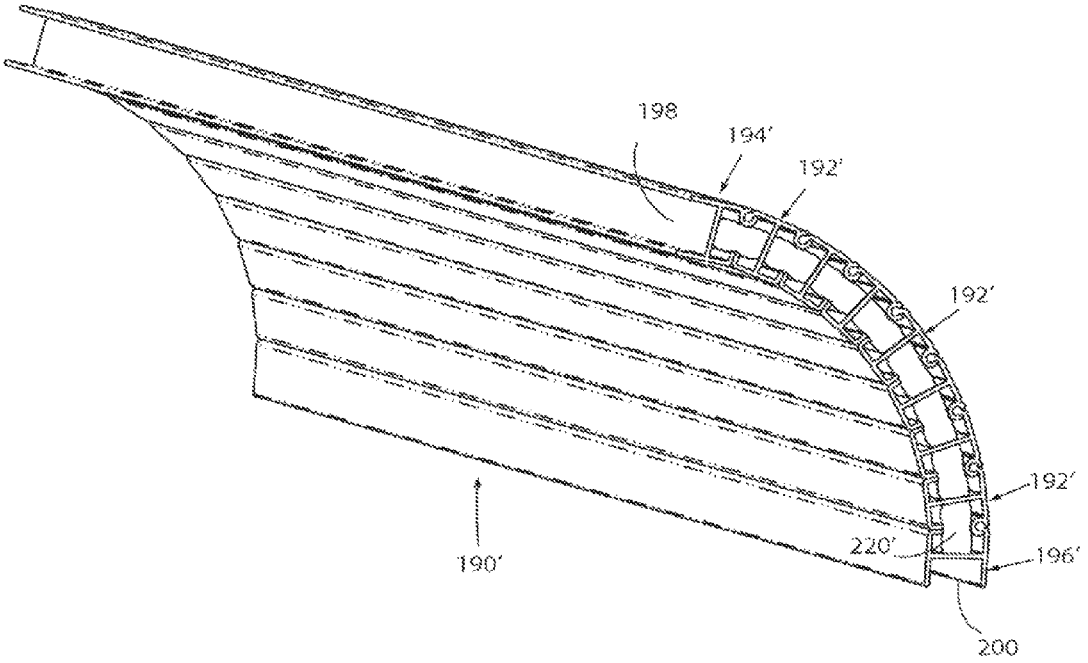
Figure 24B:
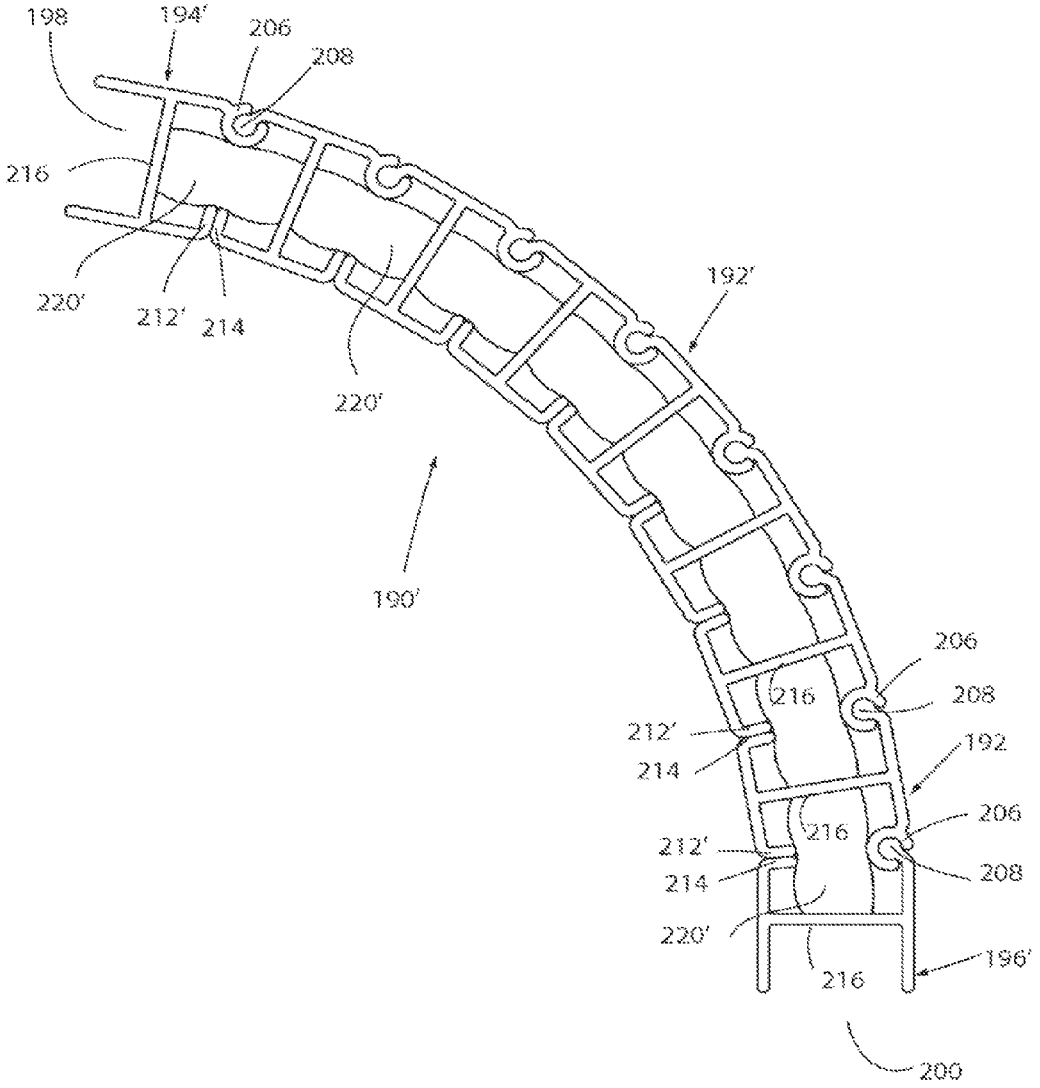
Figure 25A:
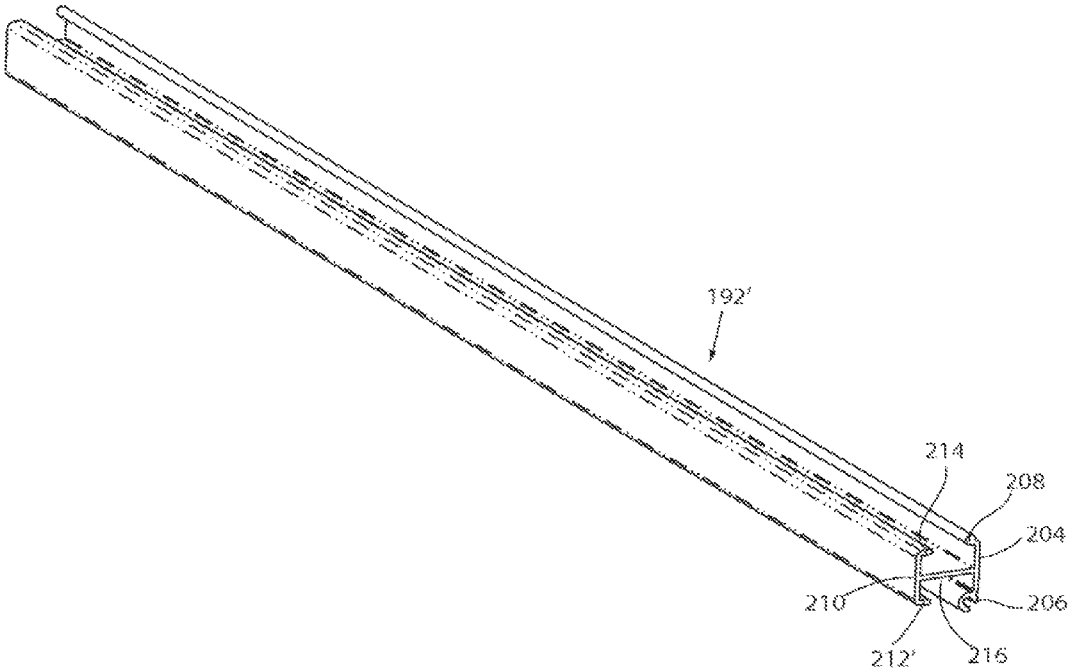
FIGS. 25A and 25B are respective isometric and end views showing one interior vertebral link of the second alternative embodiment of the vertebral column.
Figure 25B:
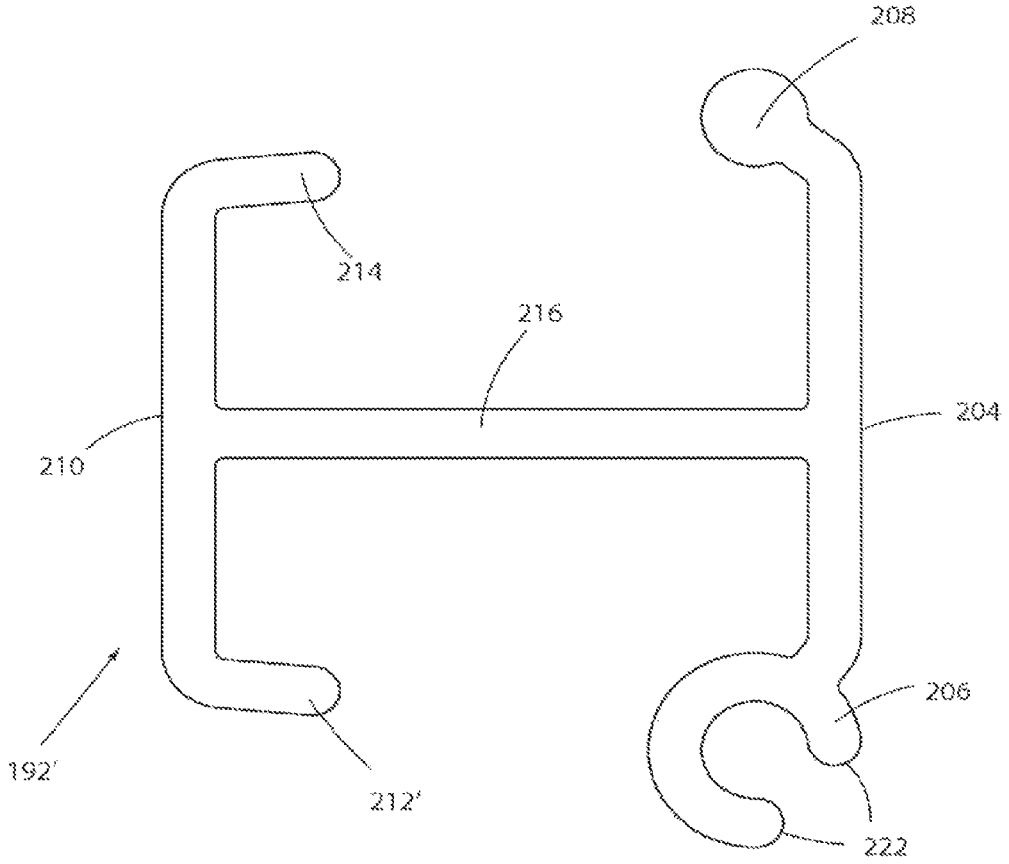
Figure 26A:
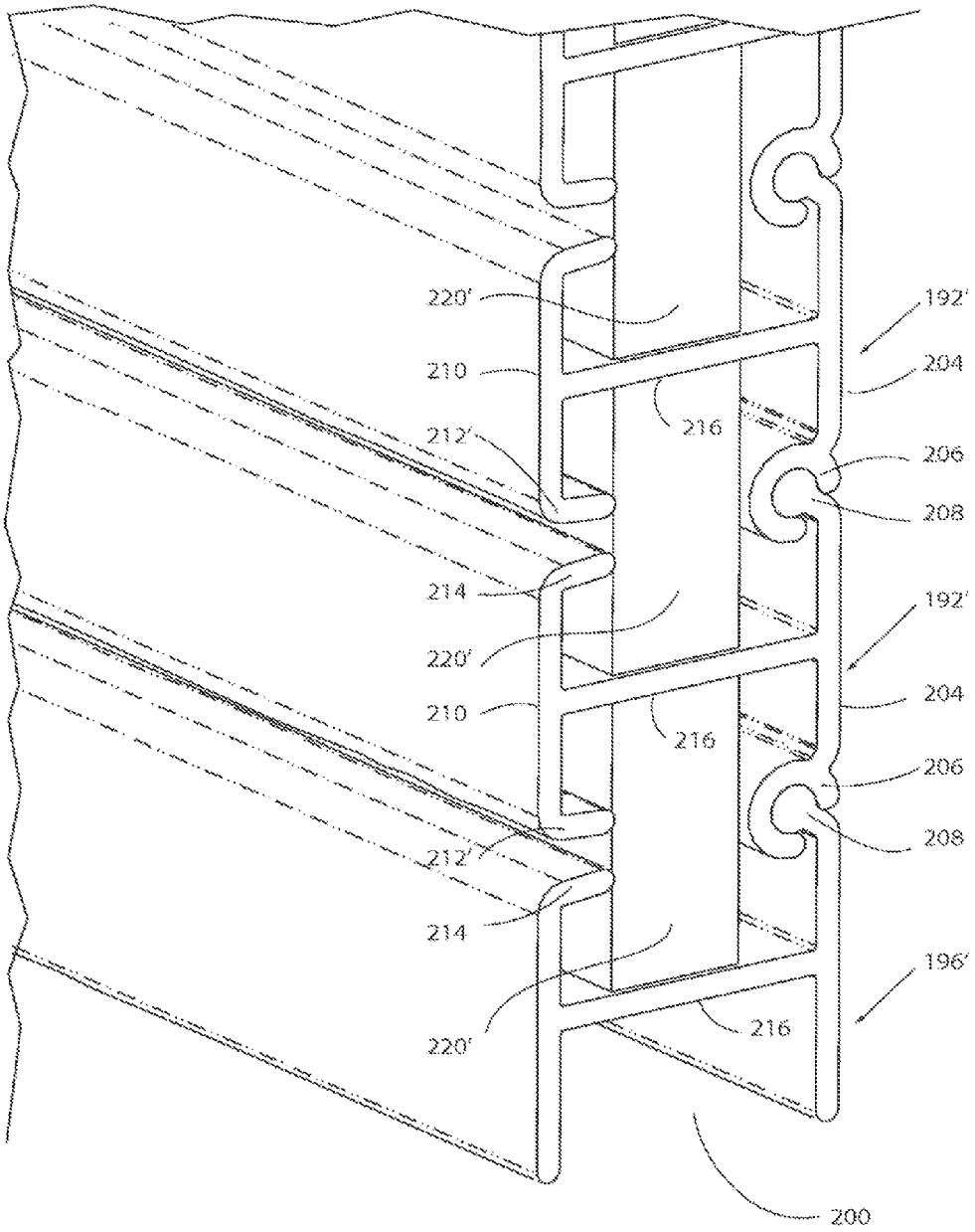
FIGS. 26A and 26B and FIGS. 27A and 27B are pairs of enlarged fragmentary respective isometric and end views showing in detail the interconnection of multiple vertebral links of the second alternative embodiment of the vertebral column in, respectively, the straightened configuration of FIGS. 23A and 23B, and in the curved configuration of FIGS. 24A and 24B.
Figure 26B:
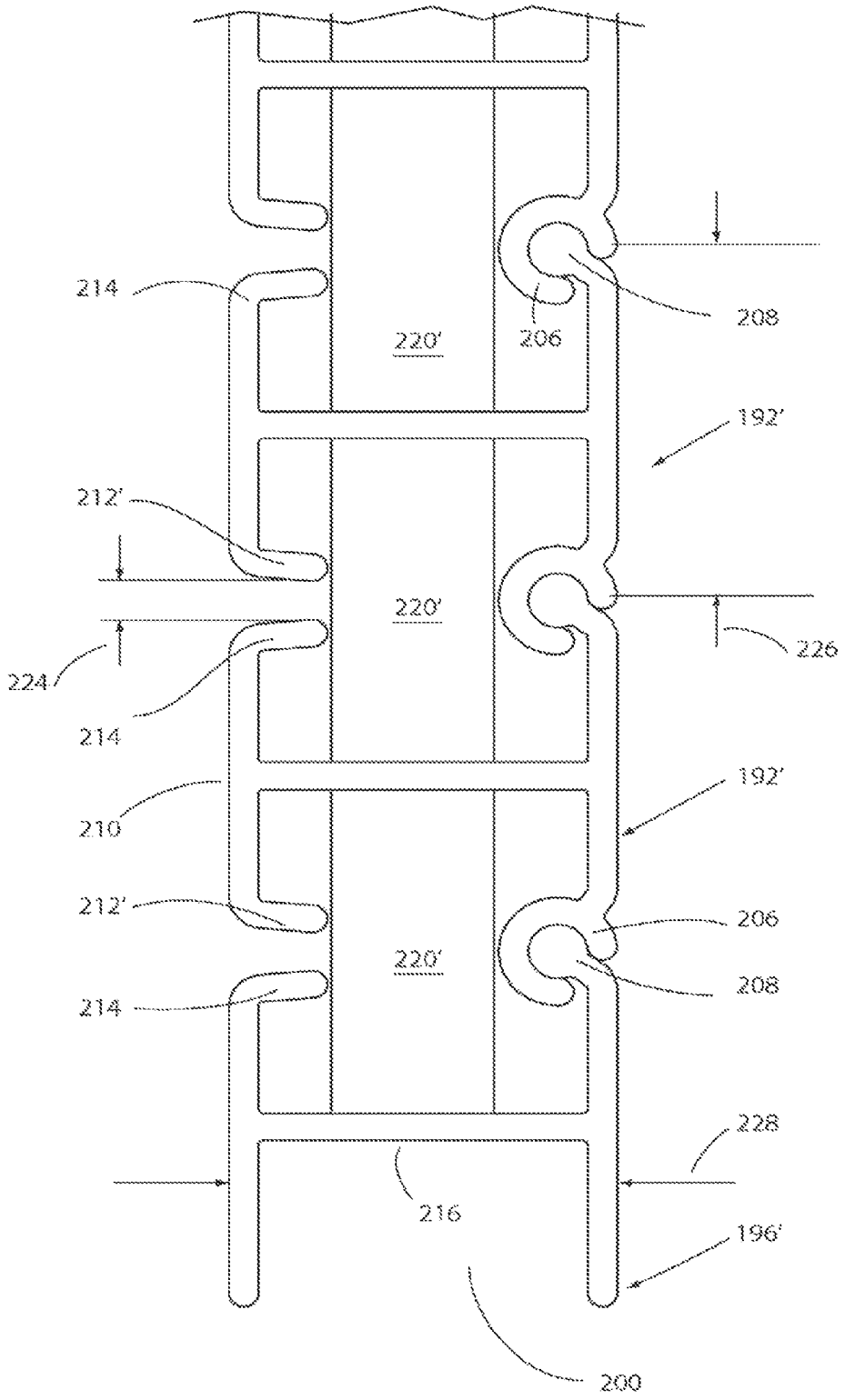
Figure 27A:
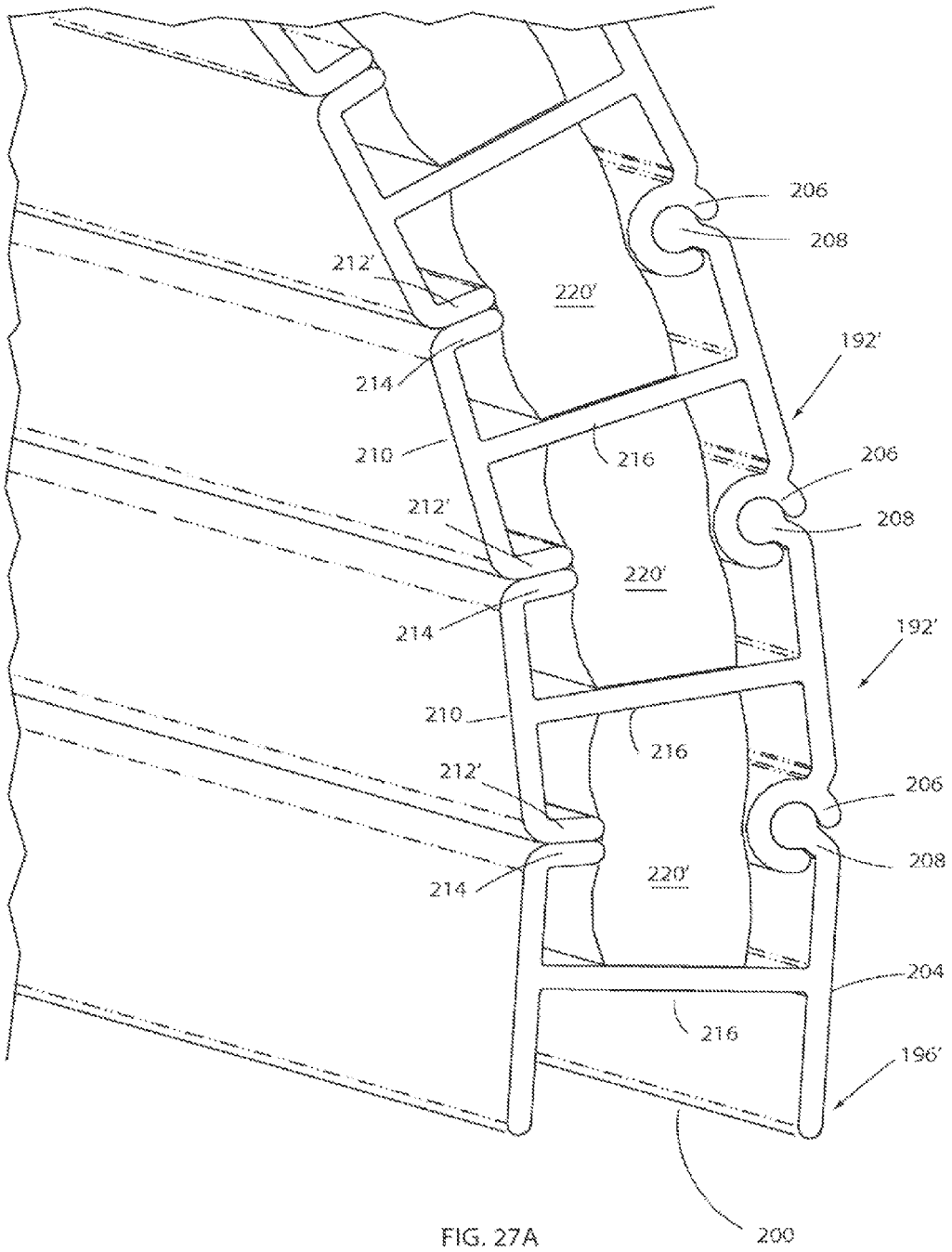
Figure 27B:
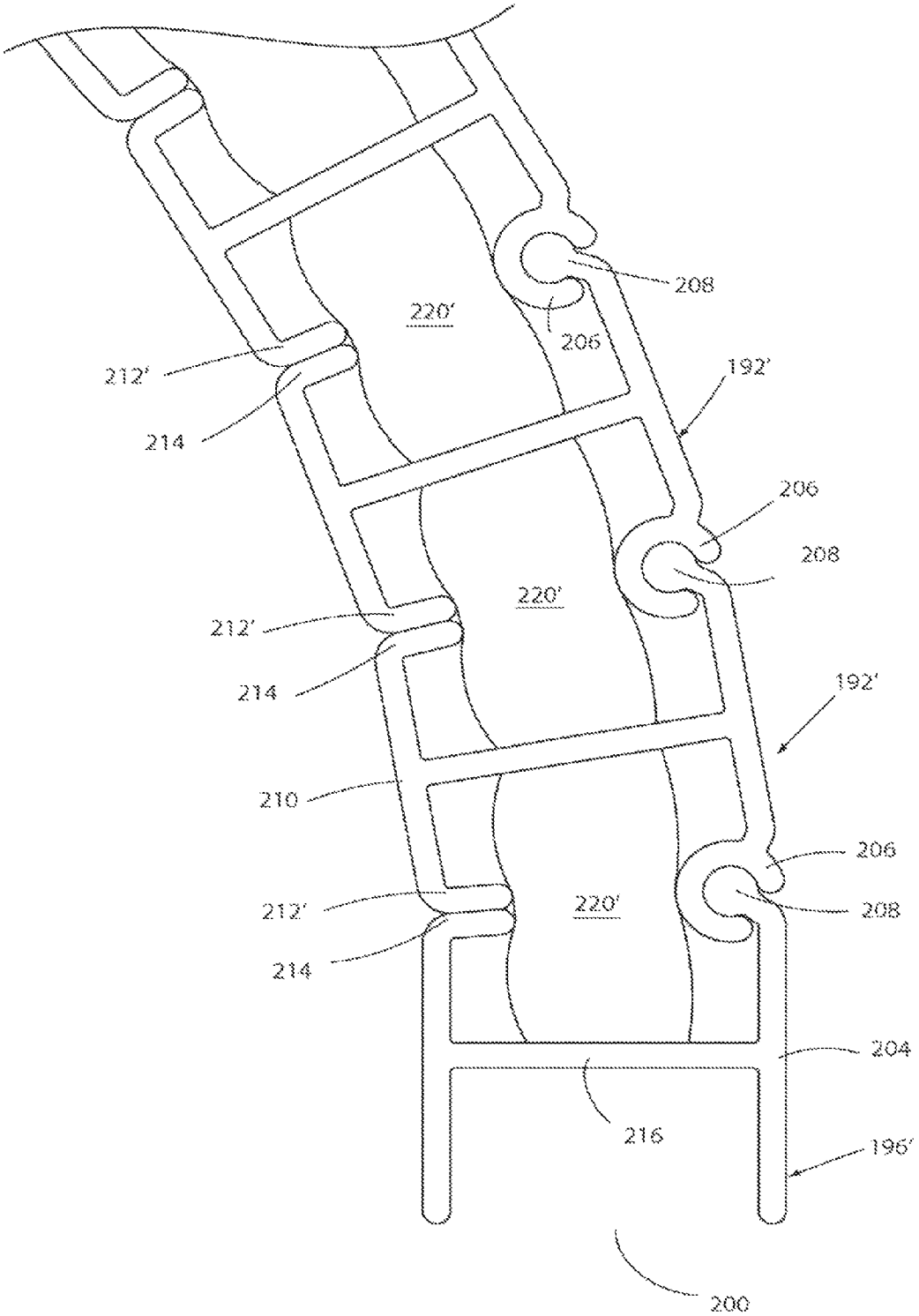

The modification of the first set of interlocking structures entails substitution of a rolled edges 212' of vertebral links 192' and 194' for hooked ends 212 of vertebral links 192 and 194. The substitution of rolled edge 212' in each vertebral link 192' and 194' results in a decoupling of adjacent rolled edges 212' and 214 of vertebral column 190', as shown in FIG. 23B. Rectangular elastomeric slat 220' is sized to form a tight fit between webs 216 of adjacent ones of vertebral links 192', 194', and 196', as shown in FIGS. 23B and 26B. FIGS. 24B and 27B show that elastomeric slat 220' undergoes compression on all sides in response to changing compressive forces imparted by different amounts of curvature of vertebral column 190' as it bends between the unfolding and folding states of folding seat 10.

FIG. 26B shows the vertebral link dimensions and separation distances of adjoining vertebral links that establish for vertebral column 190' the progressive incremental angular displacements of pivots 208 interlocked within their associated hinge sleeves 206 to achieve the straightened configuration shown in FIG. 23B (unfolded state of folding seat 10) and the curved configuration of FIG. 24B (folded state of folding seat 10). With reference to FIG. 26B, adjacent rolled edges 212' and 214 in the straightened configuration are separated by a distance 224' of 2.59 mm. A center-to-center distance 226 of open-end hinge sleeve 26 and pivot 208 of the first set of interlocking structures on underside member 210 of each interior vertebral link 192 is 19.7 mm. The width of vertebral column 190' is a distance 228 of 19.7 mm between the outer surfaces of seat side member 204 and underside member 210 of each of vertebral links 192', 194', and 196'. FIG. 27B shows the complete closure of separation distance 224' and resulting contact between adjacent rolled edges 212' and 214 in the folded state of folding seat 10. FIGS. 24B and 27B show the convergence of adjacent rolled edges 212' and 214 of vertebral column 190' bent in the folded state of folding seat 10.

End-coupling vertebral links 194 and 196 at opposite ends of vertebral column 190 and end-coupling vertebral links 194' and 196' at opposite ends of vertebral column 190' each receive fasteners (not shown) to attach one of the end-coupling vertebral links to seat mount 36 and the opposite one of the end-coupling vertebral links to seat base 38 to form complete seat assemblies 24.

It will be obvious to those having skill in the art that many changes may be made to the details of the above-described embodiments without departing from the underlying principles of the invention. For example, substitution of a single, wide spring band for spring bands 40 and 42 may be acceptable in certain configurations of folding seat 10. The scope of the present invention should, therefore, be determined only by the following claims.

The invention claimed is:

1. A compact folding furniture piece configured for convenient storage, comprising:

an object support assembly including an articulated vertebral column positioned between a support mount and a table base and including a spring mechanism, the table base comprising a table top surface;

the articulated vertebral column comprising multiple vertebral members arranged in lengthwise parallel alignment with one another and operatively connected to one another by multiple connecting members and the spring mechanism;

the spring mechanism comprising multiple spaced-apart spring mechanism components that cooperate with the operatively connected vertebral members to form a flexible unit including the support mount, the vertebral column, and the table base;

the support mount being mounted on an upstanding mounting structure such that the support mount is positioned below the table base in a normal position of use;

the table base having opposite ends between which is located the table top surface, one end of the table base connected to the vertebral column, and the other end of the table base constituting a free end of the table top surface; and the multiple spring mechanism components exhibiting flexibility properties such that when the support mount is mounted on the upstanding mounting structure, the object support assembly assumes at rest an unfolded state in which the vertebral column is substantially straight to provide a closed table top surface and, in response to an externally applied bending force, assumes a folded state in which the vertebral column is curved to provide a raised, open table top surface on which an object can rest.

2. The folding furniture piece of claim 1, in which the table top surface is an uncushioned surface layer positioned on the table base to provide a hard table top surface.

3. The folding furniture piece of claim 1, in which the multiple spring mechanism components comprise multiple spring bands.

4. The folding furniture piece of claim 3, in which the multiple spring bands comprise two nonextensible flat springs.

5. The folding furniture piece of claim 3, in which the multiple connecting members include multiple screws passing through each of the multiple spring bands and fixed in respective multiple holes spaced along the length of each of the multiple vertebral members.

6. The folding furniture piece of claim 1, in which the multiple spring mechanism components include resilient deformable members, and in which the multiple vertebral members of the articulated vertebral column include vertebral links interconnected by web sections confining the resilient deformable members to form an integral distributed spring mechanism.

7. The folding furniture piece of claim 6, in which the resilient deformable members include elastomeric material.

8. The folding furniture piece of claim 6, in which the multiple connecting members include interlocking pivot and sleeve devices formed on adjacent vertebral links of the articulated vertebral column.

9. The folding furniture piece of claim 1, in which the multiple vertebral members of the vertebral column include lengthwise parallel-aligned slats.

10. The folding furniture piece of claim 9, in which the lengthwise parallel-aligned slats include an alternating sequence of beveled slats having beveled ends and corner slats having right-angle corner ends.

11. The folding furniture piece of claim 1, in which the multiple connecting members include interlocking pivot and sleeve devices formed on adjacent vertebral members.

12. The folding furniture piece of claim 1, in which the multiple connecting members include multiple screws fixed in respective multiple holes spaced apart along the length of each of the multiple vertebral members.

13. The folding furniture piece of claim 1, in which the articulated vertebral column is curved through an angle of less than 180° as the table base assumes a horizontal position in the folded state.

14. The folding furniture piece of claim 1, further comprising magnets operatively connected to the table top surface and the upstanding mounting structure, the magnets positioned in alignment to attract so that the support mount and the table base lie substantially in the same plane when the object support assembly assumes the unfolded state.

* * * * *